US007845185B2

(12) United States Patent
Knight et al.

(10) Patent No.: US 7,845,185 B2
(45) Date of Patent: Dec. 7, 2010

(54) METHOD AND APPARATUS FOR DEHUMIDIFICATION

(75) Inventors: John Terry Knight, Moore, OK (US); Anthony William Landers, Yukon, OK (US); Patrick Gordon Gavula, Oklahoma City, OK (US); Stephen Blake Pickle, Norman, OK (US)

(73) Assignee: York International Corporation, York, PA (US)

( * ) Notice: Subject to any disclaimer, the term of this patent is extended or adjusted under 35 U.S.C. 154(b) by 853 days.

(21) Appl. No.: 11/165,106

(22) Filed: Jun. 23, 2005

(65) Prior Publication Data

US 2006/0137371 A1 Jun. 29, 2006

Related U.S. Application Data

(60) Provisional application No. 60/640,038, filed on Dec. 29, 2004.

(51) Int. Cl.
*F25B 41/00* (2006.01)

(52) U.S. Cl. ..... 62/196.4; 62/176.6; 62/176.5; 62/173; 62/90

(58) Field of Classification Search ..... 62/176.6, 62/196.4, 176.5, 173, 90
See application file for complete search history.

(56) References Cited

U.S. PATENT DOCUMENTS

| | | | |
|---|---|---|---|
| 2,047,827 | A | 7/1936 | Lamb |
| 2,154,136 | A | 4/1939 | Parcaro |
| 2,169,900 | A | 8/1939 | Philipp |
| 2,172,877 | A | 9/1939 | Parcaro |
| 2,195,781 | A | 4/1940 | Newton |
| 2,196,473 | A | 4/1940 | Ploeger |
| 2,200,118 | A | 5/1940 | Miller |
| 2,222,241 | A | 6/1940 | Philipp |
| 2,215,327 | A | 9/1940 | Karsten |
| 2,237,332 | A | 4/1941 | Bretzlaff et al |
| 2,249,856 | A | 7/1941 | Ruff |
| 2,285,042 | A | 6/1942 | MacDonald, Jr. |

(Continued)

FOREIGN PATENT DOCUMENTS

| | | | |
|---|---|---|---|
| DE | 3638875 | A1 | 7/1987 |

(Continued)

OTHER PUBLICATIONS

International Search Report from PCT Application No. PCT/US2005/047055 (May 11, 2006).

(Continued)

*Primary Examiner*—Frantz F Jules
*Assistant Examiner*—Azim Rahim
(74) *Attorney, Agent, or Firm*—McNees Wallace & Nurick LLC

(57) ABSTRACT

An HVAC system including a compressor, a condenser and an evaporator arrangement connected in a closed refrigerant loop. The evaporator arrangement includes a plurality of refrigerant circuits. The evaporator arrangement also includes at least one distributor configured to distribute and deliver refrigerant to each circuit of the plurality of circuits. The plurality of circuits are arranged into a first and second set of circuits. The evaporator arrangement also includes a valve configured and disposed to isolate the first set of circuits from refrigerant flow from the condenser and provide flow of refrigerant from the compressor in a dehumidification operation of the HVAC system.

11 Claims, 13 Drawing Sheets

U.S. PATENT DOCUMENTS

| | | | | |
|---|---|---|---|---|
| 2,304,269 | A | 12/1942 | McGrath | |
| 2,332,981 | A | 10/1943 | Anderson | |
| 2,451,385 | A | 10/1948 | Groat | |
| 2,515,842 | A | 7/1950 | Swinburne | |
| 2,564,310 | A | 8/1951 | Nussbaum et al. | |
| 2,679,142 | A | 5/1954 | McGrath | |
| 2,682,758 | A | 7/1954 | Harris | |
| 2,702,456 | A | 2/1955 | Ringquist et al. | |
| 2,715,320 | A | 8/1955 | Wright | |
| 2,729,072 | A | 1/1956 | Dybvig | |
| 2,734,348 | A | 2/1956 | Wright | |
| 2,770,100 | A | 11/1956 | Raney | |
| 2,844,946 | A | 7/1958 | Bauer | |
| 2,874,550 | A | 2/1959 | Musson | |
| 2,926,503 | A | 3/1960 | Neubauer | |
| 2,932,178 | A | 4/1960 | Armstrong et al. | |
| 2,940,281 | A | 6/1960 | Armstrong | |
| 2,970,281 | A | 6/1960 | Armstrong | |
| 2,952,989 | A | 9/1960 | Gould et al. | |
| 2,961,844 | A | 11/1960 | McGrath | |
| 2,963,877 | A | 12/1960 | Malkoff et al. | |
| 3,012,411 | A | 12/1961 | Kjellman | |
| 3,026,687 | A | 3/1962 | Robson | |
| 3,060,699 | A | 10/1962 | Tilney | |
| 3,067,587 | A | 12/1962 | McFarlan | |
| 3,105,366 | A | 10/1963 | Atchison | |
| 3,119,239 | A | 1/1964 | Sylvan | |
| 3,139,735 | A | 7/1964 | Malkoff et al. | |
| 3,203,196 | A | 8/1965 | Malkoff | |
| 3,248,895 | A | 5/1966 | Mauer | |
| 3,264,840 | A * | 8/1966 | Harnish | 62/173 |
| 3,293,874 | A | 12/1966 | Gerteis | |
| 3,316,730 | A | 5/1967 | Lauer | |
| 3,320,762 | A | 5/1967 | Murdoch | |
| 3,357,199 | A | 12/1967 | Harnish | |
| 3,358,469 | A | 12/1967 | Quick | |
| 3,362,184 | A | 1/1968 | Jensen | |
| 3,402,564 | A | 9/1968 | Nussbaum | |
| 3,402,566 | A | 9/1968 | Leimbach | |
| RE26,593 | E * | 5/1969 | Lauer | 62/160 |
| 3,460,353 | A | 8/1969 | Ogata et al. | |
| 3,469,412 | A | 9/1969 | Giuffre | |
| RE26,695 | E | 10/1969 | Jenson | |
| 3,520,147 | A | 7/1970 | Glackman | |
| 3,525,233 | A | 8/1970 | Pond | |
| 3,540,526 | A | 11/1970 | Hoaglund et al. | |
| 3,631,686 | A | 1/1972 | Kautz | |
| RE27,522 | E | 11/1972 | Schenk et al. | |
| 3,738,117 | A | 6/1973 | Engel | |
| 3,779,031 | A | 12/1973 | Akiyama et al. | |
| 3,798,920 | A * | 3/1974 | Morgan | 62/173 |
| 3,921,413 | A | 11/1975 | Kohlbeck | |
| 3,977,205 | A | 8/1976 | Dreisziger et al. | |
| 4,012,920 | A | 3/1977 | Kirschbaum | |
| 4,018,584 | A | 4/1977 | Mullen | |
| 4,089,368 | A | 5/1978 | Bell, Jr. et al. | |
| 4,105,063 | A | 8/1978 | Bergt | |
| 4,182,133 | A | 1/1980 | Haas et al. | |
| 4,184,341 | A | 1/1980 | Friedman | |
| 4,189,929 | A | 2/1980 | Russell | |
| 4,270,362 | A | 6/1981 | Lancia et al. | |
| 4,287,722 | A | 9/1981 | Scott | |
| 4,313,313 | A | 2/1982 | Chrostowski et al. | |
| 4,328,682 | A | 5/1982 | Vana | |
| 4,350,023 | A | 9/1982 | Kuwabara et al. | |
| 4,389,855 | A | 6/1983 | Ueda et al. | |
| 4,430,866 | A | 2/1984 | Willitts | |
| 4,448,597 | A | 5/1984 | Kuwabara et al. | |
| 4,474,018 | A | 10/1984 | Teagan | |
| 4,476,690 | A | 10/1984 | Iannelli | |
| 4,502,292 | A | 3/1985 | Ares et al. | |
| 4,517,810 | A | 5/1985 | Foley et al. | |
| 4,557,116 | A | 12/1985 | Kittler | |
| 4,566,288 | A | 1/1986 | O'Neal | |
| 4,667,479 | A | 5/1987 | Doctor | |
| 4,711,094 | A | 12/1987 | Ares et al. | |
| 4,738,120 | A | 4/1988 | Lin | |
| 4,761,966 | A | 8/1988 | Stark | |
| 4,785,640 | A | 11/1988 | Naruse | |
| 4,803,848 | A | 2/1989 | LaBrecque | |
| 4,815,298 | A | 3/1989 | Van Steenburgh, Jr. | |
| 4,862,702 | A | 9/1989 | O'Neal | |
| 4,920,756 | A | 5/1990 | Howland et al. | |
| 4,942,740 | A | 7/1990 | Shaw et al. | |
| 4,984,433 | A | 1/1991 | Worthington | |
| 5,005,379 | A | 4/1991 | Brown | |
| 5,031,411 | A | 7/1991 | Gehring et al. | |
| 5,065,586 | A | 11/1991 | Shapiro-Baruch | |
| 5,088,295 | A | 2/1992 | Shapiro-Baruch | |
| 5,123,263 | A | 6/1992 | Gustafson | |
| 5,181,552 | A | 1/1993 | Eiermann | |
| 5,231,845 | A | 8/1993 | Sumitani et al. | |
| 5,277,034 | A | 1/1994 | Hojo et al. | |
| 5,305,822 | A | 4/1994 | Kogetsu et al. | |
| 5,309,725 | A | 5/1994 | Cayce | |
| 5,319,940 | A | 6/1994 | Yakaski | |
| 5,329,782 | A | 7/1994 | Hyde | |
| 5,333,470 | A | 8/1994 | Dinh | |
| 5,337,577 | A | 8/1994 | Eiermann | |
| 5,351,502 | A | 10/1994 | Gilles et al. | |
| 5,355,690 | A | 10/1994 | Iritani et al. | |
| 5,400,607 | A | 3/1995 | Cayce | |
| 5,493,871 | A | 2/1996 | Eirmann | |
| 5,622,057 | A * | 4/1997 | Bussjager et al. | 62/173 |
| 5,651,258 | A | 7/1997 | Harris | |
| 5,664,425 | A | 9/1997 | Hyde | |
| 5,666,813 | A | 9/1997 | Brune | |
| 5,682,754 | A | 11/1997 | Groenewold | |
| 5,689,962 | A | 11/1997 | Rafalovich | |
| 5,743,098 | A | 4/1998 | Behr | |
| 5,752,389 | A * | 5/1998 | Harper | 62/176.5 |
| 5,802,862 | A | 9/1998 | Eiermann | |
| 5,823,006 | A | 10/1998 | Jung | |
| 5,826,433 | A | 10/1998 | Dube | |
| 5,826,434 | A | 10/1998 | Belding et al. | |
| 5,845,702 | A | 12/1998 | Dinh | |
| 5,915,473 | A | 6/1999 | Ganesh et al. | |
| 5,953,926 | A | 9/1999 | Dressler et al. | |
| 5,983,652 | A | 11/1999 | Iritani et al. | |
| 5,992,160 | A | 11/1999 | Bussjager et al. | |
| 5,992,161 | A | 11/1999 | O'Halloran et al. | |
| 5,996,365 | A | 12/1999 | Tanaka | |
| 6,021,644 | A | 2/2000 | Ares et al. | |
| 6,055,818 | A | 5/2000 | Valle et al. | |
| 6,122,923 | A | 9/2000 | Sullivan | |
| 6,123,147 | A | 9/2000 | Pittman | |
| 6,167,714 | B1 | 1/2001 | Baffes | |
| 6,212,892 | B1 | 4/2001 | Rafalovich | |
| 6,260,366 | B1 | 7/2001 | Pan | |
| 6,298,680 | B1 | 10/2001 | Chopko et al. | |
| 6,332,496 | B1 | 12/2001 | Takano et al. | |
| 6,338,254 | B1 | 1/2002 | Alsenz | |
| 6,347,527 | B1 | 2/2002 | Bailey et al. | |
| 6,385,985 | B1 | 5/2002 | Bussjager et al. | |
| 6,386,281 | B1 | 5/2002 | Ganesh et al. | |
| 6,389,825 | B1 | 5/2002 | Wightman | |
| 6,389,833 | B1 | 5/2002 | Bouloy | |
| 6,422,308 | B1 | 7/2002 | Okawara et al. | |
| 6,427,461 | B1 | 8/2002 | Whinery et al. | |
| 6,508,066 | B1 | 1/2003 | Mierins et al. | |
| 6,644,049 | B2 | 11/2003 | Alford | |
| 6,644,052 | B1 | 11/2003 | Wightman | |
| 6,658,874 | B1 | 12/2003 | Trent | |
| 6,666,040 | B1 | 12/2003 | Groenewold et al. | |

| | | | | |
|---|---|---|---|---|
| 6,705,093 | B1 | 3/2004 | Taras et al. | |
| 6,792,767 | B1 | 9/2004 | Pargeter et al. | |
| 6,826,921 | B1 | 12/2004 | Uselton | |
| 7,028,492 | B2 * | 4/2006 | Taras et al. | 62/159 |
| 2002/0125333 | A1 | 9/2002 | Ganesh et al. | |
| 2002/0170302 | A1 | 11/2002 | Bagley | |
| 2003/0177779 | A1 | 9/2003 | Loke | |
| 2003/0196445 | A1 * | 10/2003 | Cho et al. | 62/197 |
| 2004/0089015 | A1 * | 5/2004 | Knight et al. | 62/324.1 |

FOREIGN PATENT DOCUMENTS

| | | | |
|---|---|---|---|
| GB | 1559607 | A | 1/1980 |
| JP | 59056028 | A | 3/1984 |
| JP | 01196462 | A | 8/1989 |
| JP | 02075860 | A | 3/1990 |
| JP | 02075861 | A | 3/1990 |
| JP | 04043262 | A | 2/1992 |
| JP | 06002969 | A | 1/1994 |
| WO | WO 92/16692 | | 10/1992 |
| WO | WO/96/39603 | | 12/1996 |
| WO | WO-03/006890 | A1 | 1/2003 |
| WO | WO-03/054457 | A1 | 7/2003 |

OTHER PUBLICATIONS

Sporlan, 3-Way Valves (Installation and Servicing Instructions), Sporlan Valve Company, Washington, MO Jun. 2001 / Bulletin 30-21.

Sporlan, 3-Way Valves (The Right Solenoid Valve for any Job), Sporlan Valve Company, Washington, MO Jun. 2001 / Bulletin 30-20.

Sporlan, Type 5D Three-Way Heat Reclaim Valve for Refrigerants 12-22-134a-502, Sporlan Valve Company, Washington, MO Dec. 1995 / Bulletin 30-10-1.

Sporlan, Solenoid Valves, Sporlan Valve Company, Washington, MO Jan. 1993 / Bulletin 30-10.

Lennox Industries Inc., Lennox Engineering Data, Bulletin No. 210317, Aug. 2003, pp. 1-40.

Lennox Industries Inc., Lennox Engineering Data, Bulletin No. 210318, Sep. 2003, pp. 1-59.

FHP Manufacturing, Technical Topics; Catalog Section: Hot Gas Reheat, Sep. 2001, pp. 1-4.

FHP Manufacturing, Hot Gas Reheat Humidimiser Application Manual, Rev. Apr. 2001, pp. 1-4.

Desert Aire, Technical Bulletin 16, 100% Outside Air Dehumidification Methods, 119 Jul. 2002, pp. 1-6.

Desert Aire, Technical Bulletin 18, Natatorium Economizer Vs. Conventional Dehumidifier, 121 Oct. 1999, pp. 1-6.

Moustafa M. Elsayed, Ph.D., Mohammed M. El-Refaee, Ph.D., Yousef A. Borhan, Energy-Efficient Heat Recovery Systems for Air Conditioning of Indoor Swimming Pools, ASHRAE Transactions: Research, pp. 259-269.

De Champs, Commercial Products, pp. 1-6.

Des Champs, Modular Outside Air Conditioning Systems, MOACS498/5M, pp. 1-15, 1998.

Dry-O-Tron, Residential & Light Commercial Dehumidifiers & Air Conditioners, MAM Series, 2002, pp. 1-4.

Trane, Engineering Bulletin RT-PRB011-EN, Trane Precedent/Voyager Dehumidification (Hot Gas Reheat) Option, Feb. 2004, pp. 1-12.

York International, Unitary Products Group, Installation Manual: Sunline MagnaDRY Gas/Electric Single Package Air Conditioners Models DR180, 240 and 300, 2004, pp. 1-64.

* cited by examiner

METHOD AND APPARATUS FOR DEHUMIDIFICATION

CROSS-REFERENCE TO RELATED APPLICATIONS

This application claims the benefit of U.S. Provisional Application No. 60/640,038 filed Dec. 29, 2004.

FIELD OF THE INVENTION

The present invention is directed to providing dehumidification in heating, ventilation and air conditioner (HVAC) systems. In particular, the present invention is directed to an arrangement for HVAC systems that can dehumidify air.

BACKGROUND OF THE INVENTION

Dehumidification of air in HVAC systems typically takes place through the use of the evaporator in cooling mode. One drawback to using an evaporator, alone, for dehumidification, is the excess reduction in air temperature that results, which is commonly referred to as overcooling. Overcooling occurs when air that is subject to dehumidification is cooled to a temperature that is below the desired temperature of the air. Overcooling is a particular problem when the dehumidification is required in a room that is already relatively cool. Overcooling generally involves air temperatures of approximately 50° F. to 55° F. or lower.

Overcooling has been addressed by utilization of a reheat coil, as disclosed in U.S. Pat. No. 5,752,389 (the '389 Patent). Air that is overcooled by the evaporator is passed over the reheat coil in order to increase the temperature of the overcooled, dehumidified air to a desired temperature. In the '389 Patent, the reheat coil is heated by diverting hot refrigerant gas through the reheat coil when dehumidification is required. Reheat may also be provided by alternate heat sources, such as electric heat or gas heat. The reheat coil system for providing heat to the dehumidified, overcooled air has several drawbacks including the requirement of additional equipment and/or piping and/or additional energy input. The presence of an additional coil in the indoor air stream results in losses that must be overcome by the indoor blower. These losses are present any time the indoor blower is running, regardless of the operational mode of the unit. The result is higher relative energy usage to circulate air with an additional coil present.

Another dehumidification method known in the art is disclosed in U.S. Pat. No. 4,182,133 (the '133 Patent). The '133 Patent is directed to a dehumidification method that controls refrigerant flow through circuits within the indoor coil of an air conditioning/heat pump unit. The '133 Patent system, when providing dehumidification, has a liquid header that distributes the refrigerant across several circuits within the indoor coil. At the opposite end of the indoor coil, the outlets of the various circuits of the coil are allowed to flow into a single common vapor header. The liquid header at the inlet of the indoor coil contains a solenoid valve that may be closed to prevent refrigerant flow to one or more of the circuits within the coil. The '133 Patent system operates such that when humidity reaches a certain level, the valve in the liquid header is closed in order to limit the number of available circuits for refrigerant flow. The area of the indoor coil that remains in the active circuit and receives refrigerant flow, experiences an increase in refrigerant flow through a given heat transfer area. The increased flow of refrigerant results in a greater amount of moisture being removed from the air in that portion of the indoor coil. The distribution to the parts of the indoor coil is achieved through a single liquid header. The operation of the '133 Patent system is only concerned with removal of humidity. One drawback of the '133 system is that the dehumidified air is not reheated and may be overcooled. Another drawback of the '133 system is that the inlet header does not distribute flow across the circuits of the evaporator, leading to uneven phase distribution of refrigerant across the evaporator heat exchanger.

Therefore, what is needed is a method and system for dehumidification that dehumidifies air without overcooling and provides a system that can be retrofitted into existing systems.

SUMMARY OF THE INVENTION

The present invention is directed to an HVAC system including a compressor, a condenser and an evaporator arrangement connected in a closed refrigerant loop. The evaporator arrangement includes a plurality of refrigerant circuits. The evaporator arrangement also includes at least one distributor configured to distribute and deliver refrigerant to each circuit of the plurality of circuits. The plurality of circuits are arranged into a first and second set of circuits. The evaporator arrangement also includes an isolation means configured and disposed to isolate the first set of circuits from refrigerant flow from the condenser and to permit flow of refrigerant from the compressor during a dehumidification operation of the HVAC system.

Another embodiment of the present invention includes an HVAC system having a compressor, a condenser and an evaporator arrangement connected in a closed refrigerant loop. The evaporator arrangement includes a plurality of refrigerant circuits. The evaporator arrangement also includes at least one distribution arrangement configured to distribute and deliver refrigerant to each circuit of the plurality of circuits. The plurality of circuits is arranged into a plurality of sets of circuits. The evaporator arrangement also includes a valve arrangement configured and disposed to isolate at least one of the sets of circuits from refrigerant flow from the condenser and to permit flow of refrigerant from the compressor during a dehumidification operation of the HVAC system.

Still another embodiment of the present invention includes a method for dehumidification. The method comprises providing a compressor, a condenser and an evaporator arrangement connected in a closed refrigerant loop. The evaporator arrangement including a plurality of refrigerant circuits. The evaporator arrangement also includes at least one distributor configured to distribute and deliver refrigerant to each circuit of the plurality of circuits. The plurality of circuits are arranged into a first and second set of circuits. The evaporator arrangement also includes a valve configured and disposed to prevent refrigerant flow from the condenser to the first set an operational mode for the refrigeration cycle. The operational mode being a selected from the group consisting of cooling and dehumidification. The first set of refrigerant circuits are isolated from flow of refrigerant from the condenser and provided with flow of refrigerant from the compressor when the operational mode is dehumidification. Flow of refrigerant is permitted from the condenser to both the first and second set of refrigerant circuits when the operational mode is cooling. Heat transfer fluid is flowed over the evaporator, the heat transfer fluid being in a heat exchange relationship with the evaporator.

One advantage of the present invention is that it may easily be retrofitted into existing systems.

Another advantage of the present invention is that the system and method distributes refrigerant substantially uniformly across the evaporator to provide substantially uniform refrigerant phase distribution and heat exchange across the evaporator.

Another advantage of the present invention is that the system can reheat air without the need for a separate airflow system.

Another advantage of the present invention is that the system does not require a discrete reheat coil.

Another advantage of this system is that enhanced dehumidification features are made available without increasing energy usage associated with circulating indoor air.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
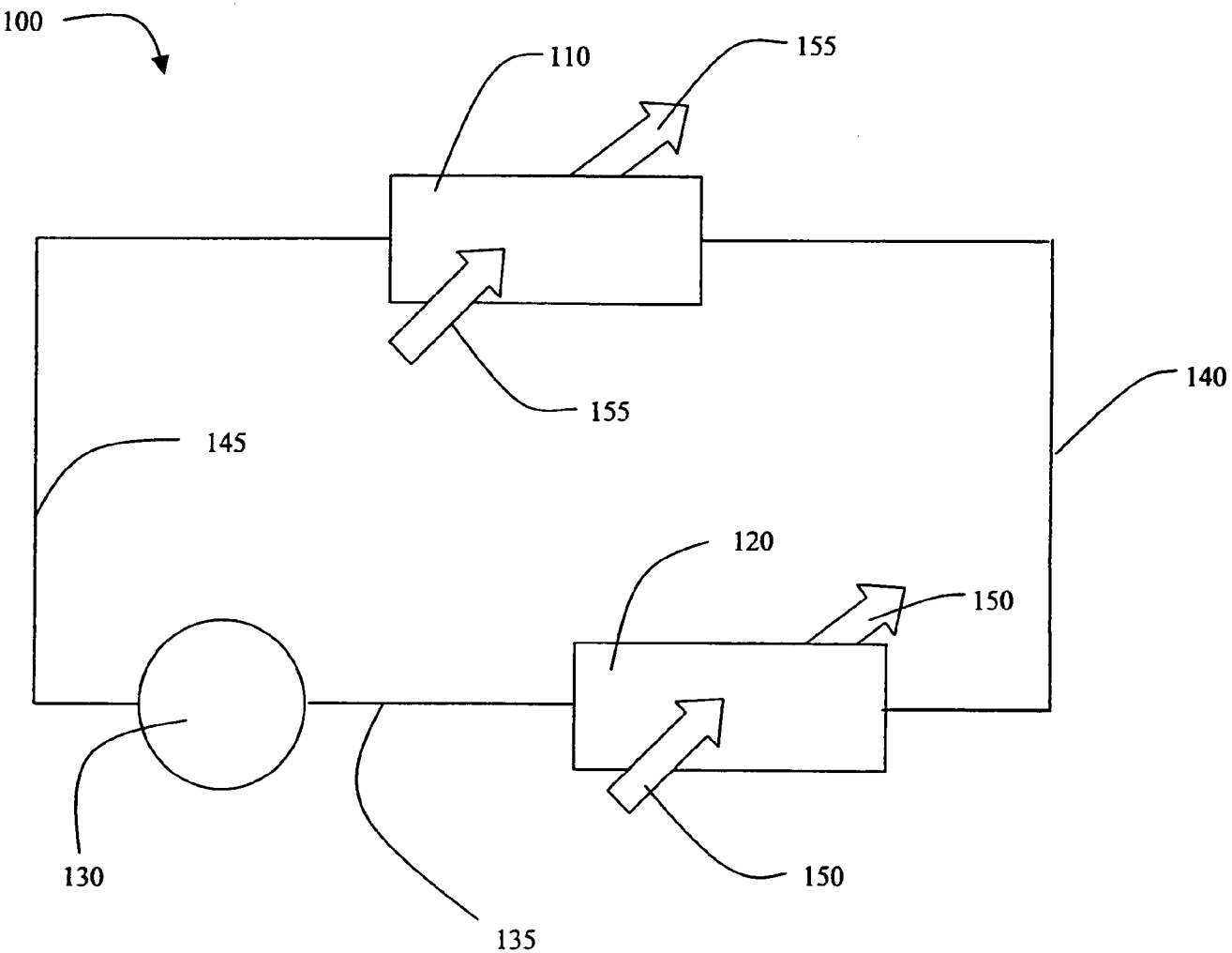
FIG. 1 illustrates schematically a refrigeration or HVAC system.
Figure 5:
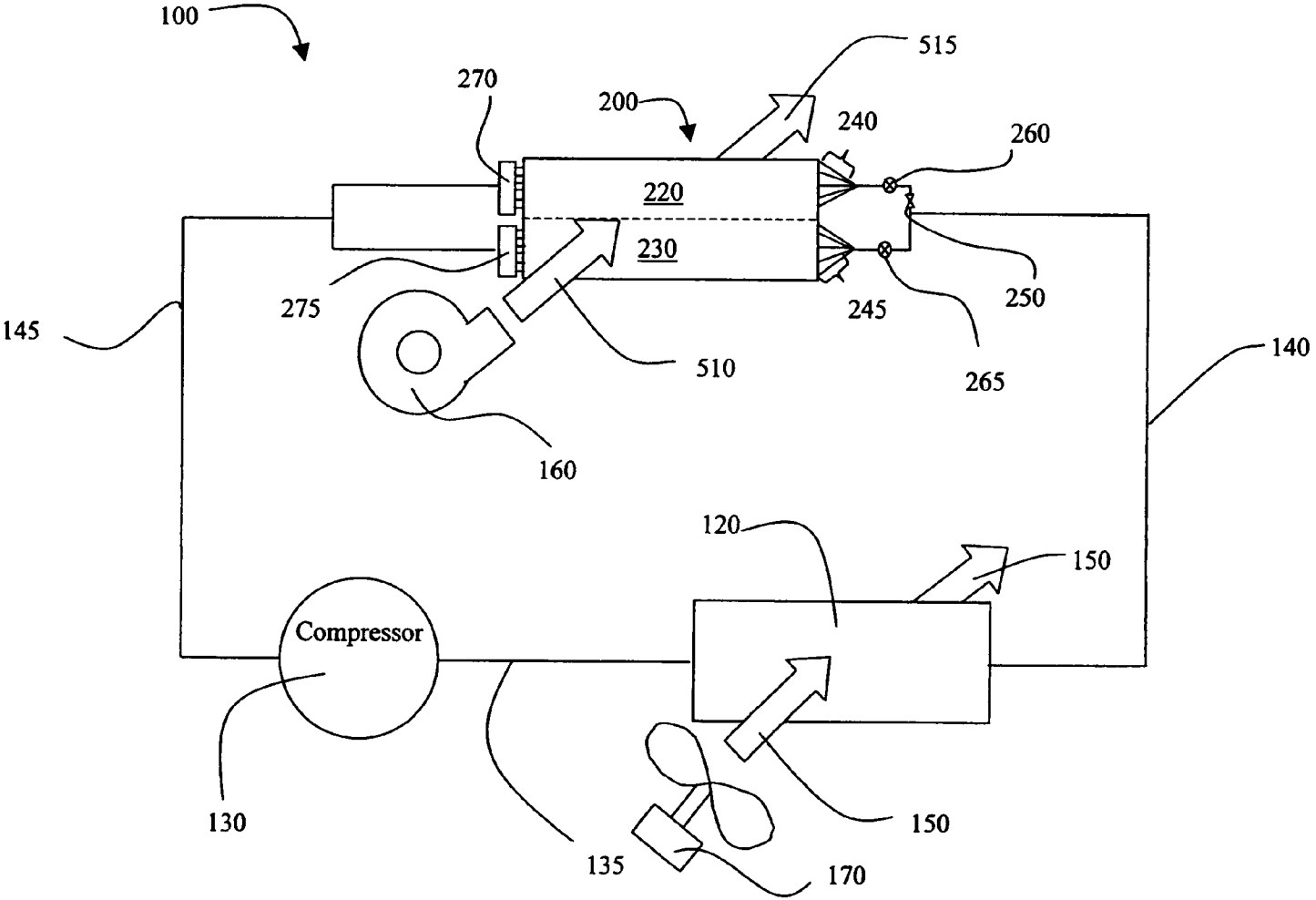
FIG. 5 illustrates schematically one embodiment of a refrigeration or HVAC system according to the present invention.

FIG. 1 illustrates a HVAC, refrigeration, or chiller refrigeration system 100. Refrigeration system 100 includes a compressor 130, a condenser 120, and an evaporator 110. Refrigerant is circulated through the refrigeration system 100. The compressor 130 compresses a refrigerant vapor and delivers it to the condenser 120 through compressor discharge line 135. The compressor 130 is preferably a reciprocating or scroll compressor, however, any other suitable type of compressor can be used, for example, screw compressor, rotary compressor, and centrifugal compressor. The refrigerant vapor delivered by the compressor 130 to the condenser 120 enters into a heat exchange relationship with a first heat transfer fluid 150 heating the fluid while undergoing a phase change to a refrigerant liquid as a result of the heat exchange relationship with the fluid 150. The first heat transfer fluid 150 is moved by use of a fan 170 (see FIG. 5), which moves the first heat transfer fluid 150 through condenser 120 in a direction perpendicular the cross section of the condenser 120. The second heat transfer fluid 155 is moved by use of a blower 160 (see FIG. 5), which moves the second heat transfer fluid 155 through evaporator 110 in a direction perpendicular the cross section of the evaporator 110. Although FIG. 5 depicts the use of a blower 160 and fan 170, any fluid moving means may be used to move fluid through the evaporator and condenser. Suitable fluids for use as the first heat transfer fluid 150 include, but are not limited to, air and water. In a preferred embodiment, the refrigerant vapor delivered to the condenser 120 enters into a heat exchange relationship with air as the first heat transfer fluid 150. The refrigerant leaves the condenser through the evaporator inlet line 140 and is delivered to an evaporator 110. The evaporator 110 includes a heat-exchanger coil. The liquid refrigerant in the evaporator 110 enters into a heat exchange relationship with the second heat transfer fluid 155 and undergoes a phase change to a refrigerant vapor as a result of the heat exchange relationship with the second fluid 155, which lowers the temperature of the second heat transfer fluid 155. Suitable fluids for use as the second heat transfer fluid 155 include, but are not limited to, air and water. In a preferred embodiment, the refrigerant vapor delivered to the evaporator 110 enters into a heat exchange relationship with air as the second heat transfer fluid 155. The vapor refrigerant in the evaporator 110 exits the evaporator 110 and returns to the compressor 130 through a compressor suction line 145 to complete the cycle. It is to be understood that any suitable configuration of condenser 120 can be used in the system 100, provided that the appropriate phase change of the refrigerant in the condenser 120 is obtained. The conventional refrigerant system includes many other features that are not shown in FIG. 1. These features have been purposely omitted to simplify the figure for ease of illustration.

Figure 2:
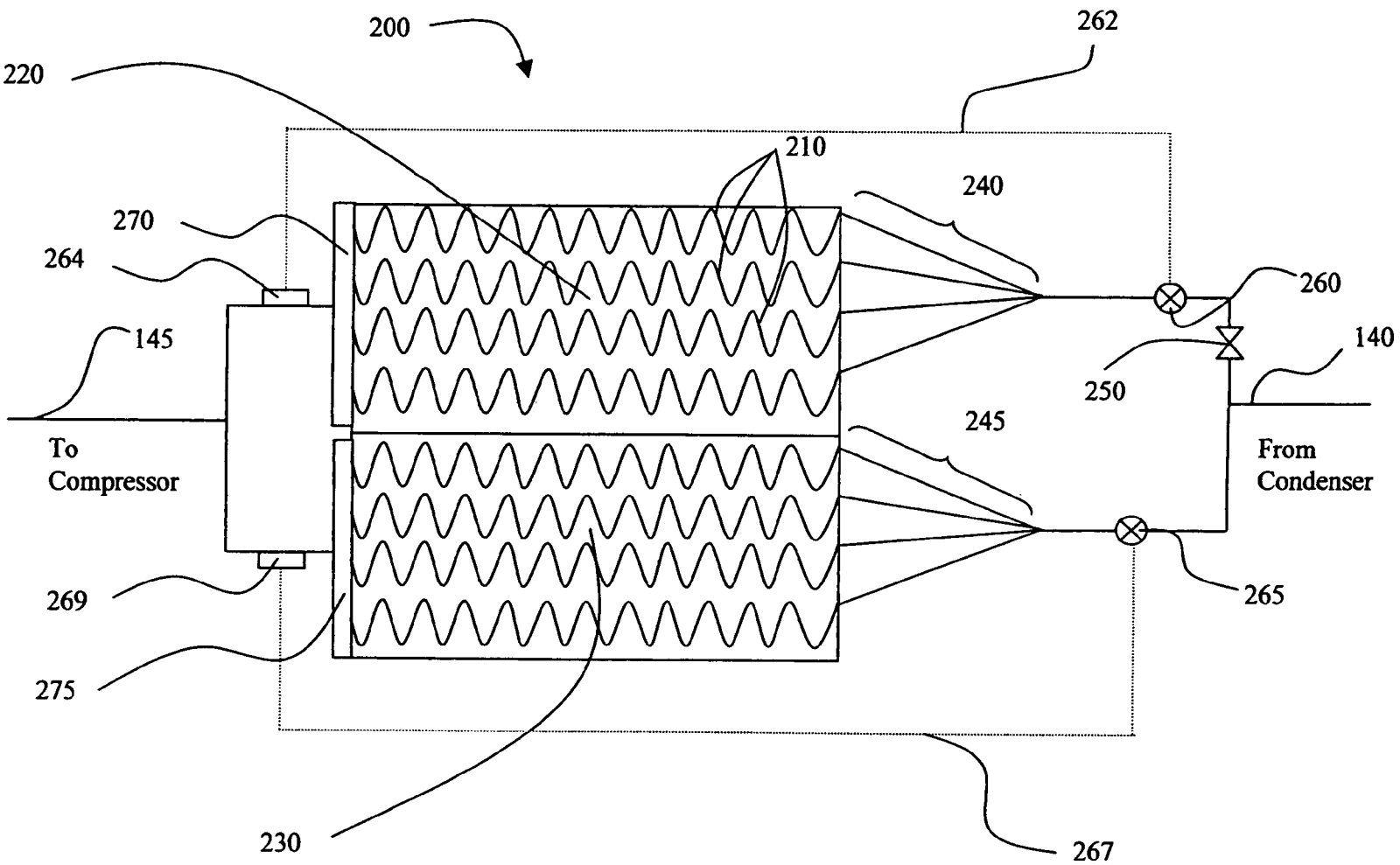
FIG. 2 illustrates one embodiment of an evaporator and piping arrangement of the present invention.

FIG. 2 illustrates a partitioned evaporator 200 according to one embodiment of the present invention. The inlet of the partitioned evaporator 200 includes an inlet line 140 from the condenser 120, a first and second expansion device 260 and 265, an isolation valve 250 and a first and second distributor 240 and 245. The expansion device may be any suitable refrigerant expanding device, including a thermostatic expansion valve, a thermal-electric expansion valve, or an orifice. The first expansion device 260 is positioned between inlet line 140 and the first distributor 240. The second expansion device 265 is positioned between the inlet line 140 and the second distributor 245. The partitioned evaporator 200 includes a plurality of refrigerant circuits 210. The number of circuits 210 may be any number of circuits 210 that provide sufficient heat transfer to maintain operation of the partitioned evaporator within the refrigerant system 100. The partitioned evaporator 200 is preferably partitioned into a first and second portion 220 and 230. Although FIG. 2 shows the evaporator 200 as only including two portions, any number of portions may be used in the present invention. The first and second evaporator portion 220 and 230 may be sized in any proportion. For example, the first evaporator portion 220 may be 60% of the size of the partitioned evaporator 200 and the second evaporator portion portion 220 may be 40% of the size of the partitioned evaporator 200 and the second evaporator portion 230 may be 60% of the size of the partitioned evaporator 200 or the first and second evaporator portions 220 and 230 may each represent 50% of the size of the partitioned evaporator 200. Although FIG. 2 shows the partitioned evaporator 200 as only including two portions, any number of portions may be used in the present invention. Where more than two evaporator portions are present, the flow may be regulated to each of the portions. For example, in the embodiment where the evaporator is split into three portions, two of the three portions include valve arrangements that allow independent isolation of each of these portions. One or both of the two portions with valve arrangements may be isolated, dependent on a signal from a controller and/or sensor.

The outlet of the partitioned evaporator 200 includes a first and second suction header 270 and 275, a first and second sensing devices 264 and 269, and a suction line 145 to the compressor 130. The first suction header 270 receives refrigerant from the circuits 210 in the first evaporator portion 220. The second suction header 275 receives refrigerant from the circuits 210 present in the second evaporator portion 230. The first sensing device 264 is positioned between the first suction header 270 and the suction line 145. The first sensing device 264 senses the temperature of the refrigerant leaving the first suction header 270 and compares the temperature of the refrigerant to the temperature of the refrigerant at the first expansion device 260 through line 262. The flow of refrigerant through the first expansion device 260 is increased as the temperature difference at the first sensing device 264 and the first expansion device 260 increases. The flow of refrigerant through the first expansion device 260 is decreased as the temperature difference at the first sensing device 264 and the first expansion device 260 decreases. The second expansion device 265 operates in the same manner with respect to the refrigerant discharge from the second suction header 275, which senses temperature at second sensing device 269, and communicates the temperature measurement to the second expansion device 265 through line 267. In an alternate embodiment of the invention, sensing devices 264 and 269 may communicate temperature to a thermostat or other control device, which provides control to the system. In yet another embodiment of the invention, the partitioned evaporator according to the invention may use a first and second expansion device 260 and 265, such as orifice plates, that do not require sensing devices 264 and 269. The isolation valve 250 allows the first portion 220 of the partitioned evaporator to be isolated from flow of refrigerant. In one embodiment, to accommodate an increased flow of refrigerant to the second evaporator portion 230, as discussed in detail below, the size of the second expansion device 265 (i.e., the amount of flow permitted through the valve) is greater than the size of the first expansion device 260.

During operation of the HVAC system 100 in cooling mode, refrigerant flows from the condenser 120 to the partitioned evaporator 200 through line 140. The flow is split into two refrigerant flow paths prior to entering the partitioned evaporator 200. Although FIG. 2 shows two paths leading to the distributors 240 and 245, the refrigerant flow may be split into two or more paths. If the system is in a cooling only mode, isolation valve 250 is open and refrigerant is permitted to flow into both the first and second portions 220 and 230 of the partitioned evaporator 200. The two refrigerant flow paths are further split by a first and second distributor 240 and 245 into a plurality of lines, corresponding to the individual refrigerant circuits 210. The first and second distributors 240 and 245 may include any number of refrigerant lines that distribute the flow to the individual circuits within the partitioned evaporator 200. Refrigerant passing through an expansion device is typically present as a two-phase fluid. Distributors provide substantially even distribution of two-phase flow. The first and second distributors 240 and 245 provide refrigerant to the circuits 210 of the partitioned evaporator 200. The distributors 240 and 245 distribute the refrigerant prior to entering the circuits 210 of the evaporator, providing uniform phase distribution across the circuits 210 of the partitioned evaporator 200 to provide substantially uniform heat transfer. The refrigerant flows into the circuits 210 of first and second evaporator portions 220 and 230. The circuits 210 permit heat transfer from the refrigerant to a second heat transfer fluid 155 to cool the second heat transfer fluid 155. The refrigerant then travels from the first and second headers 270 and 275 past the first and second sensing devices 264 and 269. The first and second sensing devices 264 and 269 sense the temperature of the refrigerant leaving the partitioned evaporator 200 and communicates the temperature to the first and second expansion devices 260 and 265 in order to determine refrigerant flow. After traveling past the first and second sensing devices 264 and 269, the refrigerant is delivered to compressor 130 through line 145.

If the system shown in FIG. 2 is in dehumidification mode, isolation valve 250 is closed and refrigerant flow to the first evaporator portion 220 is prevented. The refrigerant flow in the second evaporator portion 230 occurs substantially as described above in cooling mode. However, the flow of refrigerant to the first evaporator portion 220 is prevented. Since flow to the first evaporator portion 220 is prevented, the flow to the second evaporator portion is increased. Due to the reduction of evaporator surface area, overall heat transfer into the evaporator coil is decreased. This reduction in evaporator surface area results in a drop on overall system pressures. Accordingly, the refrigerant present in the evaporator will boil at a lower temperature than it did previously resulting in greater dehumidification over that portion of the evaporator coil. Therefore, when the second heat transfer fluid 155 is passed through the second evaporator portion 230 the second heat transfer fluid 155 is cooled and dehumidified, and the second heat transfer fluid 155 passing through the first evaporator portion remains substantially unchanged in temperature and humidity from inlet to outlet. The second heat transfer fluid 155 passed through the second evaporator portion 230 is generally overcooled and the second heat transfer fluid 155 passed through the first evaporator portion 220 is warmer. The warmer second heat transfer fluid 155 that passes though the first evaporator portion 220 mixes with the second heat transfer fluid 155 passing through the second evaporator portion 230 and produces an outlet heat transfer fluid, preferably air, that is dehumidified and not overcooled. As shown in FIG. 2, the flow of the second heat transfer fluid 155 is substantially perpendicular to the cross-section of the evaporator. The direction of the flow is such that the heat transfer fluid 155 flows simultaneously through first evaporator portion 220 and second evaporator portion 230. A single means for moving the second heat transfer fluid 155, such as an air blower 160, can be used to simultaneously move air through first evaporator portion 220 and second evaporator portion 230.

Figure 3:
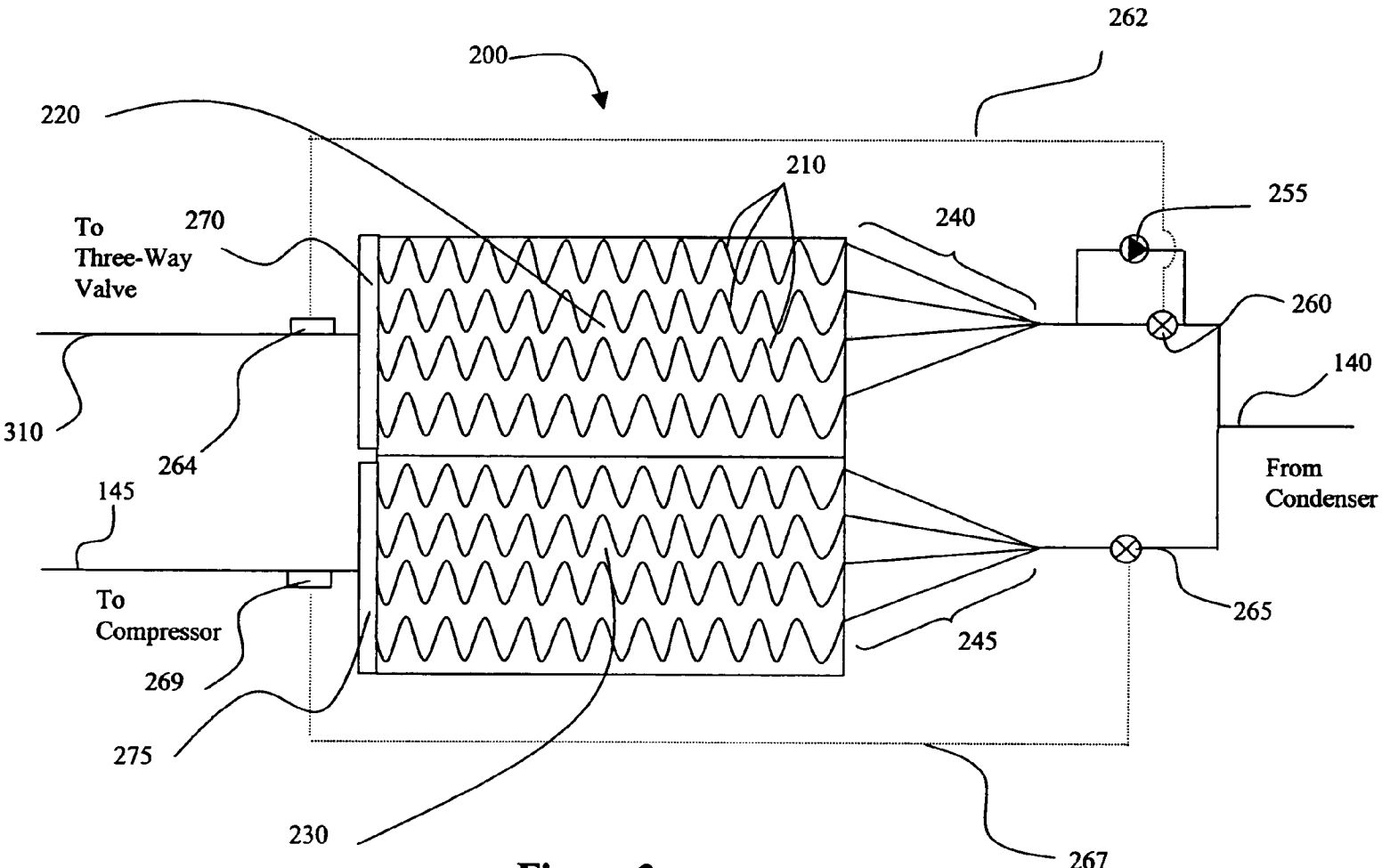
FIG. 3 illustrates another embodiment of an evaporator and piping arrangement of the present invention.

FIG. 3 illustrates a partitioned evaporator 200 according to another embodiment of the present invention. The inlet of the partitioned evaporator 200 includes substantially the same arrangement of components as FIG. 2, including an inlet line 140 from the condenser 120, expansion devices 260 and 265, check valve 255 and first and second distributors 240 and 245. Although FIG. 3 shows check valve 255 as a separate device, the check valve may be integrated into the expansion device. The check valve 255 is any suitable device capable of blocking flow in one direction, while permitting flow in the opposite direction. The partitioned evaporator 200 includes substantially the same arrangement of refrigerant circuits 210 as FIG. 2. The outlet of the partitioned evaporator shown in FIG. 3 includes the first and second suction headers 270 and 275, first and second sensing devices 264 and 269, a suction line 145 to the compressor 130 and a suction line 310 to a three-way valve 610 (see FIG. 6). The first suction header 270 receives refrigerant from the circuits 210 present in the first evaporator portion 220. The second suction header 275 receives refrigerant from the circuits 210 present in the second evaporator portion 220. The first sensing device 264 is positioned on discharge line 310. The first sensing device 264 senses the temperature of the refrigerant leaving the first suction header 270 and compares the temperature of the refrigerant to the temperature of the refrigerant at the first expansion device 260 through line 262. The flow of refrigerant through the first expansion device 260 is increased as the temperature difference at the first sensing device 264 and the first expansion device 260 increases. The flow of refrigerant through the first expansion device 260 is decreased as the temperature difference at the first sensing device 264 and the first expansion device 260 decreases. The second expansion device 265 operates in the same manner with respect to the refrigerant discharge from the second header 275 and communicates the temperature measurement to the second expansion 265 through line 267. The use of independent expansion devices 260 and 265 allows independent control of the flow through each of the portions of the evaporator.

During operation in cooling mode, FIG. 3, like in the system shown in FIG. 2, refrigerant flows from the condenser 120 into the partitioned evaporator 200 through line 140, through the valve arrangement, including the first and second expansion devices 260 and 265, and into the first and second distributors 240 and 245. The circuits 210 permit heat transfer to the refrigerant from the second heat transfer fluid 155 that flows through the circuits perpendicular to the cross-section shown in FIG. 3. Due to the heat transfer with the second heat transfer fluid 155, the refrigerant entering the first and second headers 270 and 275 generally has a higher temperature than the temperature of the refrigerant entering the partitioned evaporator. The refrigerant flow through line 310 from the first header 270 travels past the first sensing device 264 and travels to a three-way valve 610, discussed in greater detail below. In cooling mode, the three-way valve 610 diverts flow from line 310 to suction line 145 and any flow of compressor discharge gas thru three-way valve 610 is prevented. The refrigerant flow through line 145 from the second header 275 travels past the second sensing device 269 to compressor 130. The sensing devices 264 and 269 sense the temperature of the refrigerant leaving the partitioned the respective flow sections of the evaporator 200 and communicate with the first and second expansion devices 260 and 265 in order to determine refrigerant flow for each flow section. After traveling past the first and second sensing devices 264 and 269, the refrigerant is delivered to the compressor 130 as discussed in detail below with regard to FIG. 6.

If the system shown in FIG. 3 is operated in dehumidification mode some refrigerant flow of compressor discharge gas is received by the three-way valve 610 and this flow of hot refrigerant gas is diverted through line 310, as discussed in greater detail below. Any flow of refrigerant from three-way valve 610 to suction line 145 is prevented. The flow from the three-way valve 610 travels through line 310 in the direction of the first suction header 270. From the first suction header 270, the hot refrigerant gas enters the first evaporator portion 220 and travels through circuits 210 to the first distributor 240. The refrigerant in circuit 210 heats second heat transfer fluid 155 as the fluid passes over circuit 210. The hot refrigerant gas is at least partially condensed to a liquid in the first evaporator portion 220. The refrigerant, which is at least partially condensed to a liquid, substantially bypasses expansion device 260 by traveling through check valve 255. The flow through check valve 255 combines with the inlet flow 140 and enters the second evaporator portion 230 through the second distributor 245. The junction point where the two refrigerant streams meet may be a "tee" junction or may be a liquid receiver. Due to the overall reduction of heat exchanger area available to the evaporating refrigerant, overall system pressure decreases resulting in lower evaporation temperatures in the lower portion of the coil. Dehumidification over this portion of the coil is increased. Simultaneously, hot gas refrigerant entering the first evaporator portion 220 of the partitioned evaporator 200 provides an increase in the temperature of the first evaporator portion 220 due to the condensing of the hot gas and the heat transfer from the hot gas. Therefore, the second heat transfer fluid 155 passing through the second evaporator portion 230 is cooled and dehumidified, while the second heat transfer fluid 155 passing through the first evaporator portion 220 receives heat exchanged from the hot gas refrigerant from the compressor discharge. This second heat transfer fluid 155 simultaneously is circulated through first and second evaporator portions 220 and 230 by fluid moving means, such as an air blower 160, when the second heat transfer fluid 155 is air. The warmer second heat transfer fluid 155 that passes though the first evaporator portion 220 mixes with the second heat transfer fluid 155 passing through the second evaporator portion 230 and produces an outlet heat transfer fluid, preferably air, that is dehumidified and not overcooled.

Figure 4:
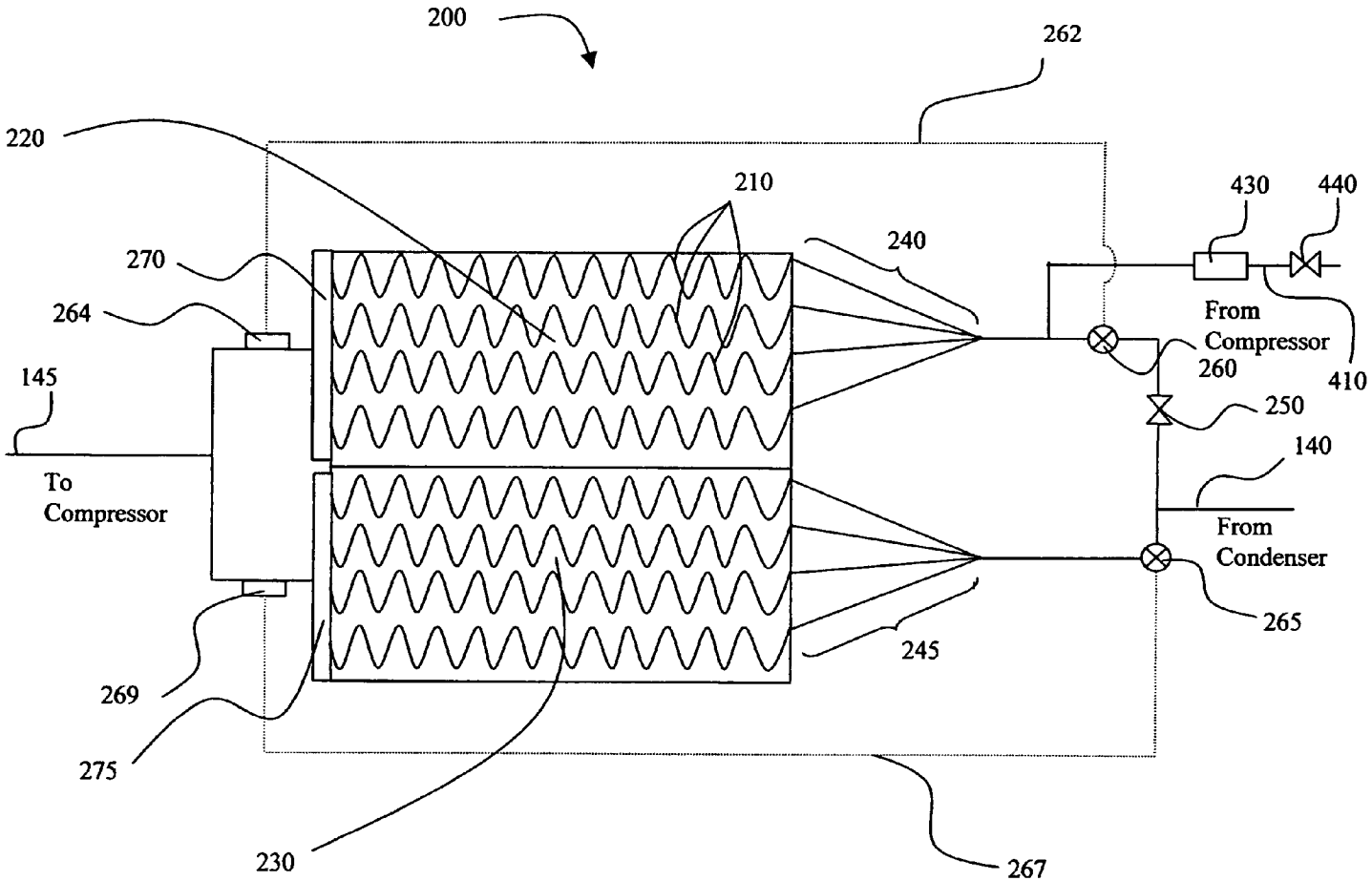
FIG. 4 illustrates further embodiment of an evaporator and piping arrangement of the present invention.

FIG. 4 illustrates a partitioned evaporator 200 according to a further embodiment of the present invention. The inlet of the partitioned evaporator 200 includes an inlet line 140 from the condenser 120, a bypass line 410 from the discharge of the compressor 130 (see FIG. 7), first and second expansion devices 260 and 265, isolation valve 250, and first and second distributors 240 and 245. The first expansion device 260 and the isolation valve 250 are positioned between inlet line 140 and the first distributor 240. Bypass line 410 connects to the line between the first expansion device 260 and the first distributor 240. Bypass line 410 is from the discharge of the compressor 130 and includes a bypass valve 440. A means of restricting flow through bypass line 410 is also present and may take the form of a flow restriction orifice 430 or flow may be restricted by adjusting the diameter and/or length of bypass line 410. The isolation valve 250 is positioned between inlet line 140 and the first expansion device 260. The second expansion device 265 is positioned between the inlet line 140 and the second distributor 245. The partitioned evaporator 200 includes substantially the same arrangement of refrigerant circuits 210 as shown in FIG. 2. The outlet of the partitioned evaporator 200 includes first and second suction headers 270 and 275, first and second sensing devices 264 and 269, and suction line 145 to the compressor 130. The first suction header 270 receives refrigerant from the circuits 210 present in the first evaporator portion 220. The second suction header 275 receives refrigerant from the circuits 210 present in the second evaporator portion 220. The first sensing device 264 is positioned between the first suction header 270 and the suction line 145. The first sensing device 264 senses the temperature of the refrigerant leaving the first suction header 270 and compares the temperature of the refrigerant to the temperature of the refrigerant at the first expansion device 260 through line 262. The flow of refrigerant through the first expansion device 260 is increased as the temperature difference at the first sensing device 264 and the first expansion device increases. The flow of refrigerant through the first expansion device 260 is decreased as the temperature difference at the first sensing device 264 and the first expansion device 260 decreases. The second expansion device 265 operates in the same manner with respect to the refrigerant discharge from the second header 275 and communicates the temperature measurement to the second expansion device 265 through line 267. The variation of the flow through manual adjustment or through signals from a controller may be optimized to provide maximum cooling and dehumidification, while maintaining a desirable temperature for the second heat transfer fluid. Isolation valve 250 allows the first portion 220 of the partitioned evaporator 200 to be isolated from flow of refrigerant from the condenser 120. In one embodiment, to accommodate the increased flow of refrigerant to the second evaporator portion 230, the size of the second expansion device 265 (i.e. the amount of flow permitted through the valve) is greater than the size of the first expansion device 260.

During operation in cooling mode, FIG. 4, like in the system shown in FIG. 2, refrigerant flows from the condenser 120 into the circuits 210 of the partitioned evaporator 200 through line 140, through the valve arrangement, including the first and second expansion devices 260 and 265, and the isolation valve 250, and into the first and second distributors 240 and 245. In cooling mode, substantially no flow of refrigerant takes place into or out of the bypass line 410. The operation of the circuits 210 and the outlet of the partitioned evaporator 200, including the first and second headers 270 and 275, the first and second sensing devices 264 and 269 and suction line 145 to the compressor is substantially similar to the operation described above with respect to FIG. 2.

However, if the system shown in FIG. 4 is in dehumidification mode, isolation valve 250 is closed and refrigerant flow to the first expansion device 260 is prevented. A portion of the refrigerant flow from the discharge of compressor 130 flows through bypass line 410 into the first distributor 240 and into the first evaporator portion 220. The hot gas refrigerant entering the first evaporator portion 220 of the partitioned evaporator 200 provides an increase in the temperature of the first evaporator portion 220. Due to the overall reduction of heat exchanger area available to the evaporating refrigerant, evaporator pressure decreases resulting in lower evaporation temperatures in the lower portion of the coil. Dehumidification over this portion of the coil is increased. Therefore, the second heat transfer fluid 155 passing through the second evaporator portion 230 is cooled and dehumidified, while the second heat transfer fluid 155 passing through the first evaporator portion 220 receives heat exchanged from the hot gas refrigerant from the compressor discharge. This second heat transfer fluid 155 simultaneously is circulated through first and second evaporator portions 220 and 230 by fluid moving means, such as an air blower 160, when the second heat transfer fluid 155 is air. The warmer second heat transfer fluid 155 that passes though the first evaporator portion 220 mixes with the second heat transfer fluid 155 passing through the second evaporator portion 230 and produces an outlet heat transfer fluid, preferably air, that is dehumidified and not overcooled.

FIG. 5 shows a refrigeration system 100 incorporating a partitioned evaporator 200 according to the present invention. FIG. 5 shows the refrigeration system, including compressor suction line 145, blower 160, compressor 130, compressor discharge line 135, condenser 120, a fan 170, evaporator inlet line 140, and first heat exchange fluid 150, substantially as described above in the description of FIG. 1. FIG. 5 also shows the partitioned evaporator 200 including first and second expansion devices 260 and 265, isolation valve 250, first and second distributors 240 and 245, first and second suction headers 270 and 275, arranged as discussed above in the description of FIG. 2. Heat transfer fluid flow 510, preferably air, flows into the partitioned evaporator 200 substantially evenly across the first and second evaporator portions 220 and 230. Blower 160 moves heat transfer fluid flow 510. Although, FIG. 5 depicts a blower, any suitable fluid moving means can be used for moving the fluid across the first and second evaporator portions 220 and 230. The heat transfer fluid enters into a heat exchange relationship with the first and second evaporator portions 220 and 230 and exits the partitioned evaporator as outlet flow 515. During cooling mode, the refrigerant is circulated from the condenser 120 to the partitioned evaporator 200, through the first and second evaporator portions 220 and 230 and to the compressor 130 through line 145. The inlet flow 510 of heat transfer fluid is cooled by both the first and second evaporator portions 220 and 230, providing outlet flow 515 of heat transfer fluid that has been cooled. During dehumidification mode, isolation valve 250 is closed, preventing flow of refrigerant into the first evaporator portion 220. The inlet flow 510 is cooled and dehumidified by the second evaporator portion 230 and is substantially untreated by the isolated first evaporator portion 220. The outlet flow 515 is a mixture of the cooled, dehumidified air that flowed through the second evaporator portion 230 and the substantially untreated air that flowed though the first evaporator portion 220. The resultant outlet flow 515 is dehumidified air that is not overcooled.

Figure 6:
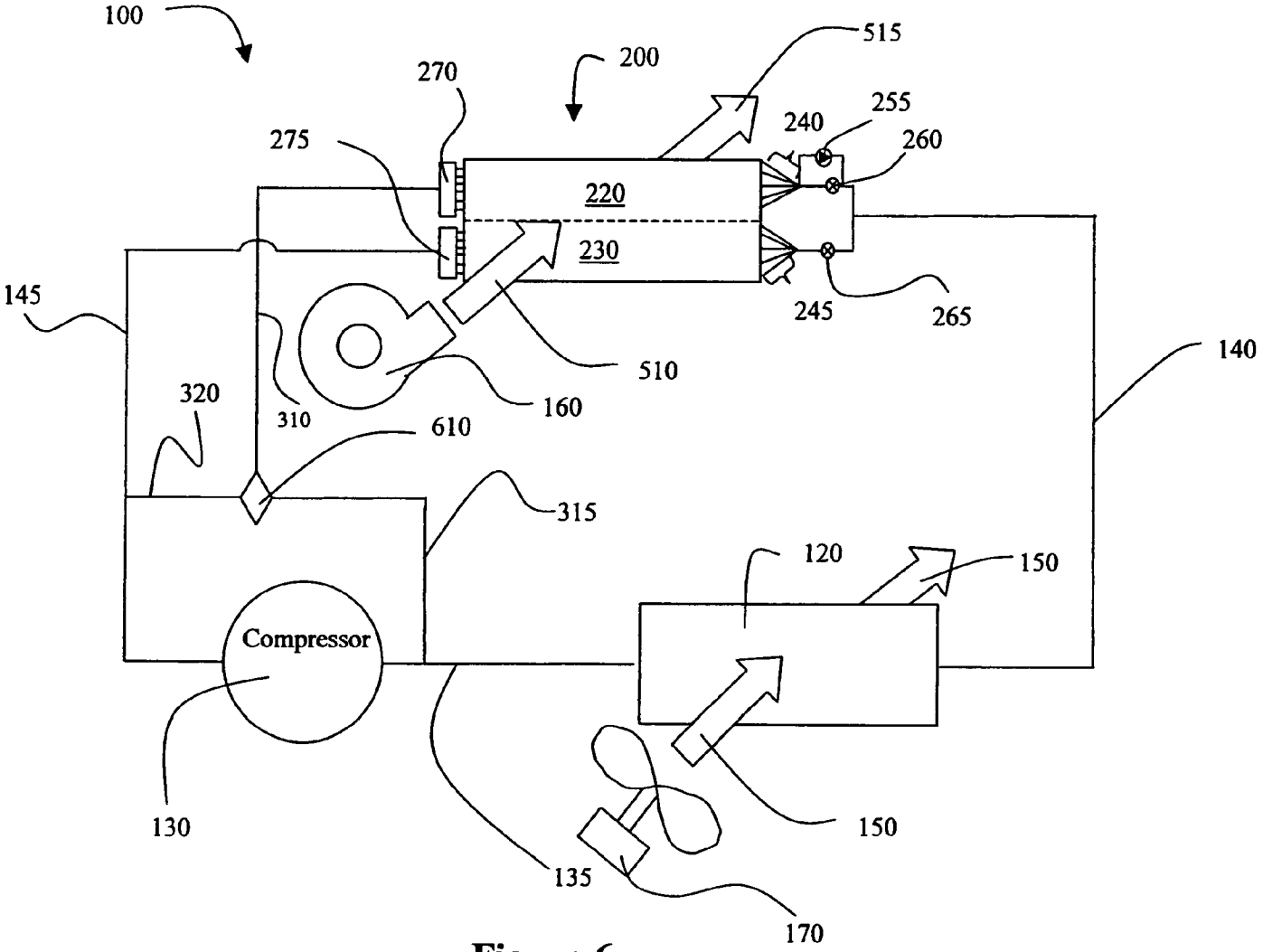
FIG. 6 illustrates schematically a refrigeration or HVAC system of another embodiment of the present invention.

FIG. 6 shows a refrigeration system 100 incorporating a partitioned evaporator 200 according to the present invention. FIG. 6 shows the refrigeration system including compressor suction line 145, blower 160, compressor 130, compressor discharge line 135, condenser 120, fan 170, evaporator inlet line 140, and first heat exchange fluid 150, substantially as described above in the description of FIG. 1. In addition, FIG. 6 includes a three-way valve 610 that connects to lines 310, 315 and 320. In cooling mode, three-way valve 610 provides a refrigerant flow path from line 310 to line 320. There is substantially no flow in line 315 during cooling mode operation. In reheat mode, three-way valve 610 provides a refrigerant flow path from line 315 to line 310. There is substantially no refrigerant flow in line 320 during reheat mode operation. FIG. 6 also shows the partitioned evaporator 200 including first and second expansion devices 260 and 265, check valve 255, first and second distributors 240 and 245, first and second suction headers 270 and 275, arranged as discussed above in the description of FIG. 3. Heat transfer fluid flow 510, preferably air, flows into the partitioned evaporator 200 substantially evenly across the first and second portions 220 and 230. A blower 160 moves heat transfer fluid flow 510. Although, FIG. 6 depicts a blower, any suitable fluid moving means can be used for moving the fluid across the first and second evaporator portions 220 and 230. The heat transfer fluid enters into a heat exchange relationship with the first and second evaporator portions 220 and 230 and exits the partitioned evaporator as outlet flow 515. During cooling mode, the refrigerant is circulated from the condenser 120 to the partitioned evaporator 200, through the first and second evaporator portions 220 and 230 and to the compressor through line 145. The inlet flow 510 of heat transfer fluid is cooled by both the first and second evaporator portions 220 and 230, providing outlet flow 515 of heat transfer fluid that has been cooled. During reheat/dehumidification mode, some portion of the hot gas refrigerant from the discharge of the compressor flows into the three-way valve 610, which is opened to allow flow through the three-way inlet line 315 and through line 310 to the suction header 270 of the first evaporator portion 220. In one embodiment of the invention, a restrictor valve may be place in compressor discharge line 135 in order to control the flow of refrigerant traveling to the condenser 120. In addition to controlling the flow of refrigerant to the condenser, the addition of a restrictor valve would allow control of the amount of refrigerant traveling to first evaporator portion 220. The restrictor valve would also allow modulation of the amount of refrigerant in order to provide increased control over the reheating capability of the first evaporator portion 220. The hot gas refrigerant from the discharge of the compressor 130 enters the circuits 210 of the first evaporator portion 220 and at least partially condenses to a liquid. The condensing refrigerant heats the first evaporator portion 220 and gives up heat to the heat transfer fluid flow 510 to produce a higher temperature heat transfer fluid outlet flow 515. The refrigerant, which is at least partially condensed, travels through the check valve 255 and combines with the inlet flow into the second evaporator portion 230. The inlet flow 510 of heat transfer fluid is cooled and dehumidified by the second evaporator portion 230 and is heated by heat exchange with the hot gas from the discharge of the compressor 130 in the isolated first evaporator portion 220, as the refrigerant gas is condensed. The outlet flow 515 is a mixture of the cooled, dehumidified air that flowed through the second evaporator portion 230 and the heated air that flowed though the first evaporator portion 220. The thoroughly mixed resultant outlet flow 515 is dehumidified air that is not overcooled. In cooling mode, first evaporator portion 220 and second evaporator portion 230 of partitioned evaporator 200, operate as evaporators. However, in dehumidification mode, first evaporator portion 220 operates as a condenser, while second evaporator portion 230 operates as an evaporator.

Figure 7:
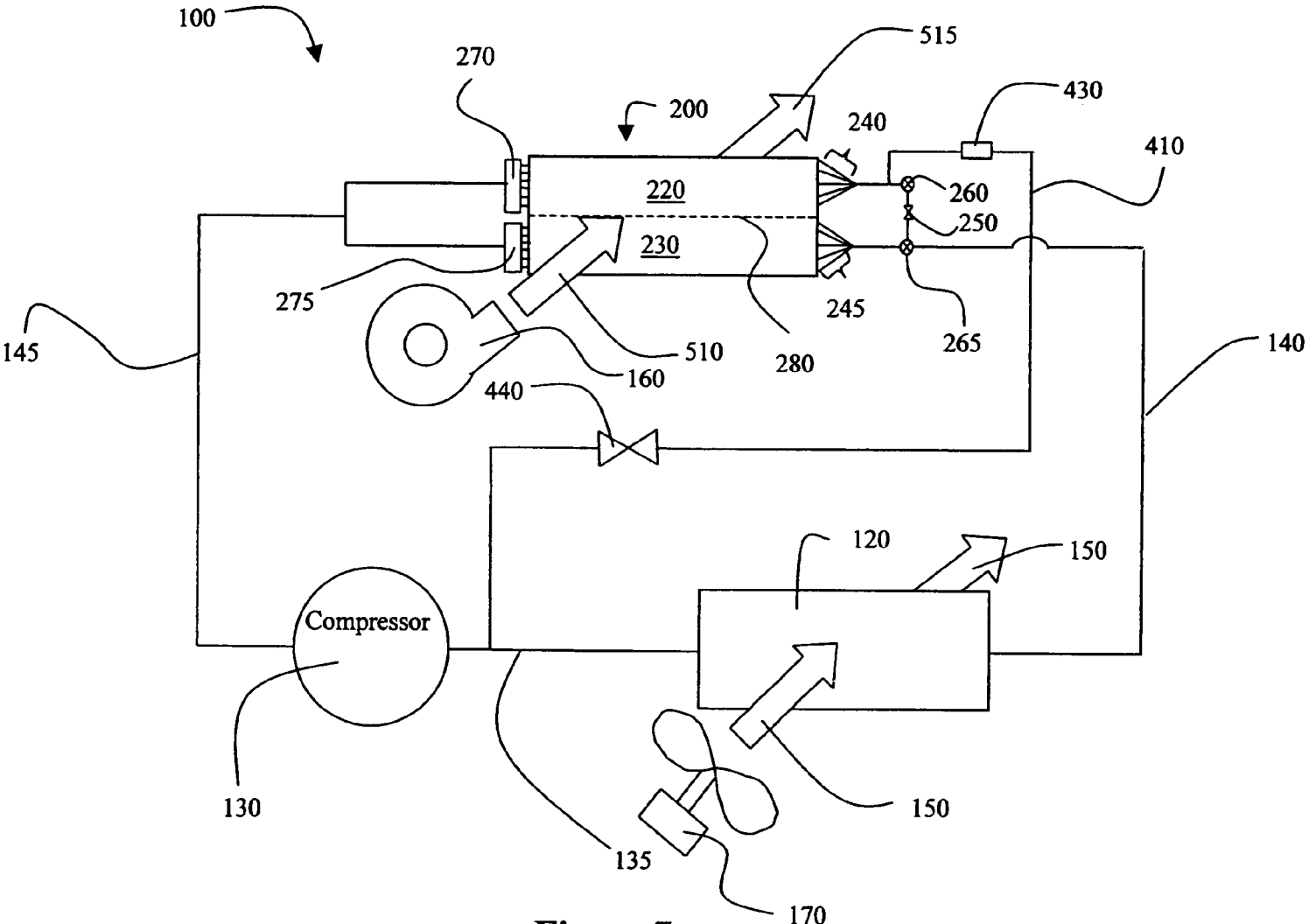
FIG. 7 illustrates schematically a refrigeration or HVAC system of a further embodiment of the present invention.

FIG. 7 shows a refrigeration system 100 incorporating a partitioned evaporator 200 according to the present invention. FIG. 7 shows the refrigeration system 100 including suction line 145, blower 160, compressor 130, compressor discharge line 135, condenser 120, fan 170, evaporator inlet line 140, and first heat exchange fluid 150, substantially as described above in the description of FIG. 1. In addition, FIG. 7 includes one or both of a bypass shutoff valve 440, and a flow restriction valve 430 on bypass line 410. Bypass line 410 connects the discharge line 135 of the compressor to the inlet of the first evaporator portion 220 between the first expansion device 260 and the first distributor 240. FIG. 7 also shows the partitioned evaporator 200 including first and expansion devices 260 and 265, isolation valve 250, first and second distributors 240 and 245, and first and second suction headers 270 and 275, arranged as discussed above in the description of FIG. 4. Heat transfer fluid flow 510, preferably air, flows into the partitioned evaporator 200 substantially evenly across the first and second portions 220 and 230. The heat transfer fluid 510 enters into a heat exchange relationship with the first and second evaporator portions 220 and 230 and exits the partitioned evaporator as outlet flow 515. During cooling mode, the refrigerant is circulated from the condenser 120 to the partitioned evaporator 200, through the first and second evaporator portions 220 and 230 and to the compressor 130 through line 145. The bypass shutoff valve 440 and the flow restriction valve 430 are set to prevent flow of refrigerant through the bypass line 410. The inlet flow 510 of heat transfer fluid is cooled by both the first and second evaporator portions 220 and 230, providing outlet flow 515 of heat transfer fluid that has been cooled. During dehumidification mode, isolation valve 250 is closed, preventing flow of condensed refrigerant into the first evaporator portion 220. The bypass shutoff valve 440 is opened and the flow restriction valve 430 is set to allow flow of refrigerant from the compressor 130. Although FIG. 7 is shown with both a bypass shutoff valve 440 and a flow restriction valve 430, either the bypass shutoff valve 440 or flow restriction valve 430 may be removed from the bypass line 410, so long as the flow of the refrigerant may be stopped during cooling mode and permitted during dehumidification mode. Hot gas refrigerant from the discharge of the compressor 130 is then allowed to flow from the compressor discharge line 135 through the bypass line 410 into the first distributor 240 and the first evaporator portion 220. The hot gas refrigerant from the discharge of the compressor 130 heats the first evaporator portion 220, but preferably does not condense, and combines with the outlet flow from the second evaporator portion 230 into the evaporator suction line 145. The inlet flow 510 of heat transfer fluid is cooled and dehumidified by the second evaporator portion 230 and is heated by heat exchange with the hot gas from the discharge of the compressor in the isolated first evaporator portion 220. The outlet flow 515 is a mixture of the cooled, dehumidified air that flowed through the second evaporator portion 230 and the heated air that flowed though the first evaporator portion 220. The resultant outlet flow 515 is dehumidified air that is not overcooled. In an alternate embodiment, valve 440 is opened when transitioning from cooling mode to dehumidification/reheat mode. In this embodiment, any liquid refrigerant present in first evaporator portion 220 is pushed toward the suction header 270 by the hot gas from the compressor passing through bypass line 410. The movement of the refrigerant allows the system to come to steady state dehumidification/reheat more quickly by not requiring the liquid refrigerant to evaporate in place. In yet another embodiment, valve 440 is operated to bypass a portion of the hot refrigerant gas from the compressor 130 around the condenser 120 during conditions of low ambient temperatures. In this mode of operation, hot gas is allowed to flow to each of the first and second evaporator portions 220 and 230 to provide some heating of the coils. Bypassing a portion of the hot gas discharge from the compressor 130 helps prevents the second evaporator portion 230 from freezing when the condenser 120 experiences cool outdoor temperatures. In this embodiment, the bypass line 410 can serve two functions simultaneously.

Figure 8:
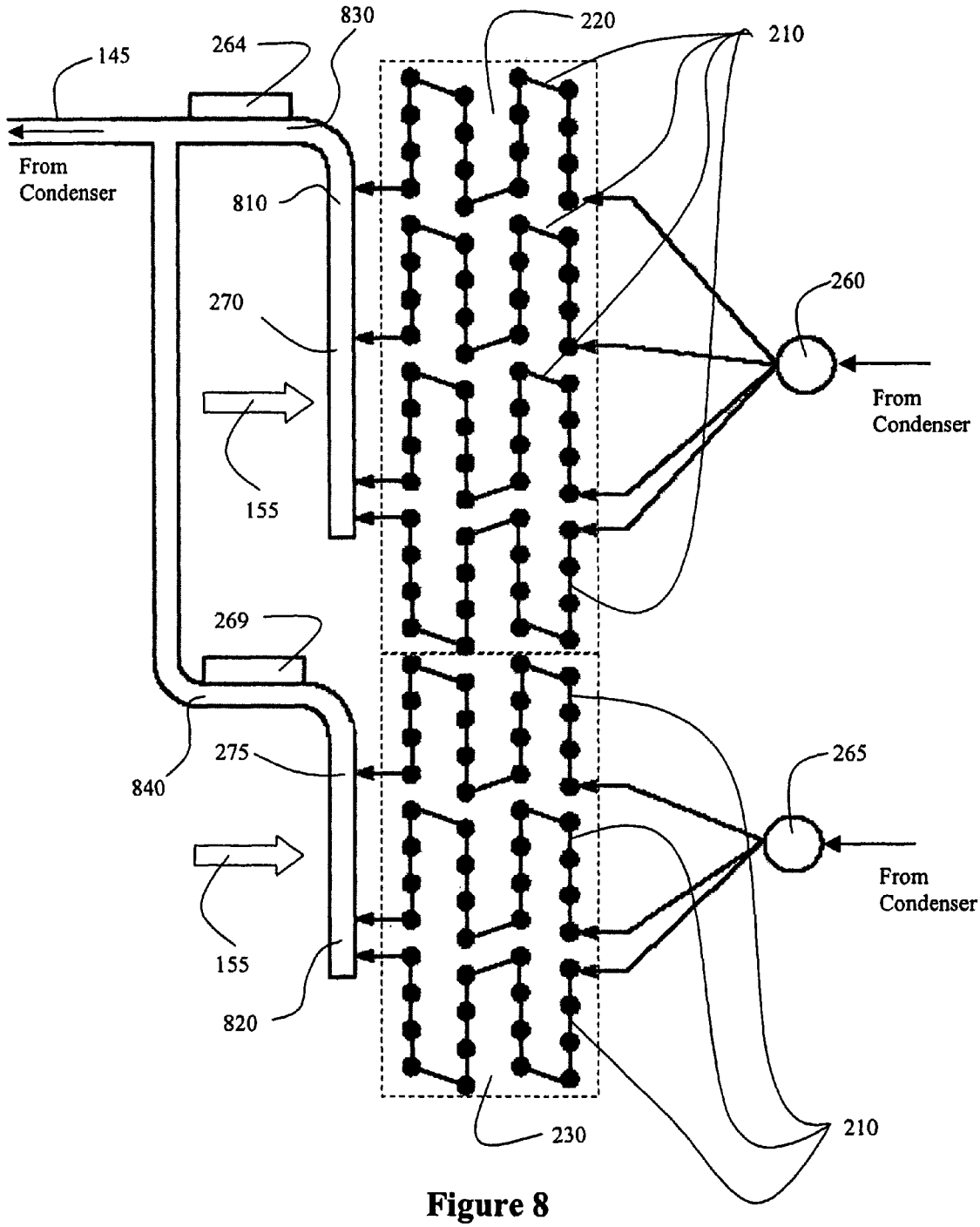
FIG. 8 schematically illustrates a suction header arrangement for an evaporator of the present invention.

FIG. 8 illustrates a preferred suction header arrangement for partitioned evaporator 200 according to a further embodiment of the present invention. The arrangement is suitable for use in the partitioned evaporator 200 of any of the embodiments shown in FIGS. 2, 4, 5 and 7. In particular, the arrangement shown includes a first and second expansion device 260 and 265, a first and second evaporator portion 220 and 230, refrigerant circuits 210, first and second sensing devices 264 and 269, first and second suction headers 270 and 275, suction line 145, second heat transfer fluid 155, as shown and described with respect to FIGS. 2, 4, 5 and 7. In this embodiment, the refrigerant circuits 210 are preferably arranged such that four refrigerant circuits 210 are present in the first evaporator portion 220 and three refrigerant circuits 210 are present in the second refrigerant portion 230. Although FIG. 8 has been shown with a four isolatable refrigerant circuits 210 to three refrigerant circuits 210 that remain open to flow in each of the operational modes, any ratio may be used that provides sufficient heat transfer surface area to provide dehumidified air that is not overcooled.

In the embodiment shown in FIG. 8, first suction header 270 includes a first vertical header tube 810 extending vertically to a horizontal outlet tube 830. The first vertical header tube 810 provides a space where liquid refrigerant, if any, from the first evaporator portion 220 falls to the bottom of first vertical header tube 810. Vaporous refrigerant escapes through horizontal outlet tube 830. The arrangement of the horizontal outlet tube 830 is such that the first sensing device 264 operates without interference form the refrigerant passing through the second evaporator portion 230 and without interference from liquid refrigerant passing through the first evaporator portion 220. Like the arrangement of first suction header 270, second suction header 275 includes a second vertical header tube 820 and a second horizontal outlet tube 840 that operate in substantially the same manner with respect to the second evaporator portion 230.

Figure 9:
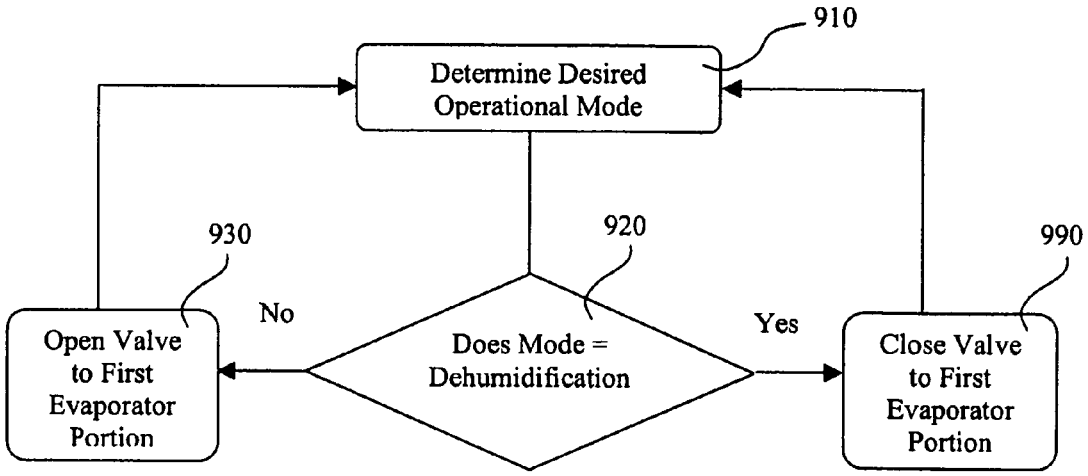
FIG. 9 illustrates a control method of the present invention.

FIG. 9 shows a control method according to one embodiment of the present invention. The method includes a mode determination step 910 where the operational mode of the system is determined or selected. The operational mode can be provided by the controller and/or user, where the mode can either be cooling only or require dehumidification. Examples of control systems for determination of the operational mode are described in further detail below in the discussion of FIGS. 12 and 13. The method then includes a decisional step 920 wherein it is determined whether dehumidification mode is required or not. If the determination in step 920 is "NO" (i.e., no dehumidification mode is required), then the method proceeds to opening step 930 wherein the valve to the first evaporator portion 220 is opened or remains open. The opening of the first evaporator portion 220 to the flow of refrigerant permits both the first and second evaporator portions 220 and 230 to provide cooling to the heat transfer fluid 510. If the decisional step 920 is a "YES" (i.e., dehumidification mode is required), then the valve to the first evaporator portion 220 is closed or remains closed. The closing of the first evaporator portion 220 to the flow of refrigerant allows the first evaporator portion 220 to equilibrate at a temperature substantially equal to the temperature of the heat transfer fluid entering the partitioned evaporator 200. After either the opening step 930 or the closing step 840, the method returns to the determination step 810 and the method repeats.

Although FIG. 9 shows that the decisional step provides a "YES" or "NO" in step 920, the method is not limited to an open or closed isolation valve 250. A flow restricting valve may also be used. The use of a flow restricting valve allows the amount of flow into the first evaporator portion 220 to be varied. For example, the flow restricting valve may be used in an operational mode that is open to full flow, partially restricted flow or closed to flow, depending on the signal from a controller. A controller, using inputs, such as refrigerant temperature, heat transfer fluid temperatures, and humidity readings, provides a signal to the restricting valve to determine the amount of refrigerant flow permitted through the isolation valve 250.

Figure 10:
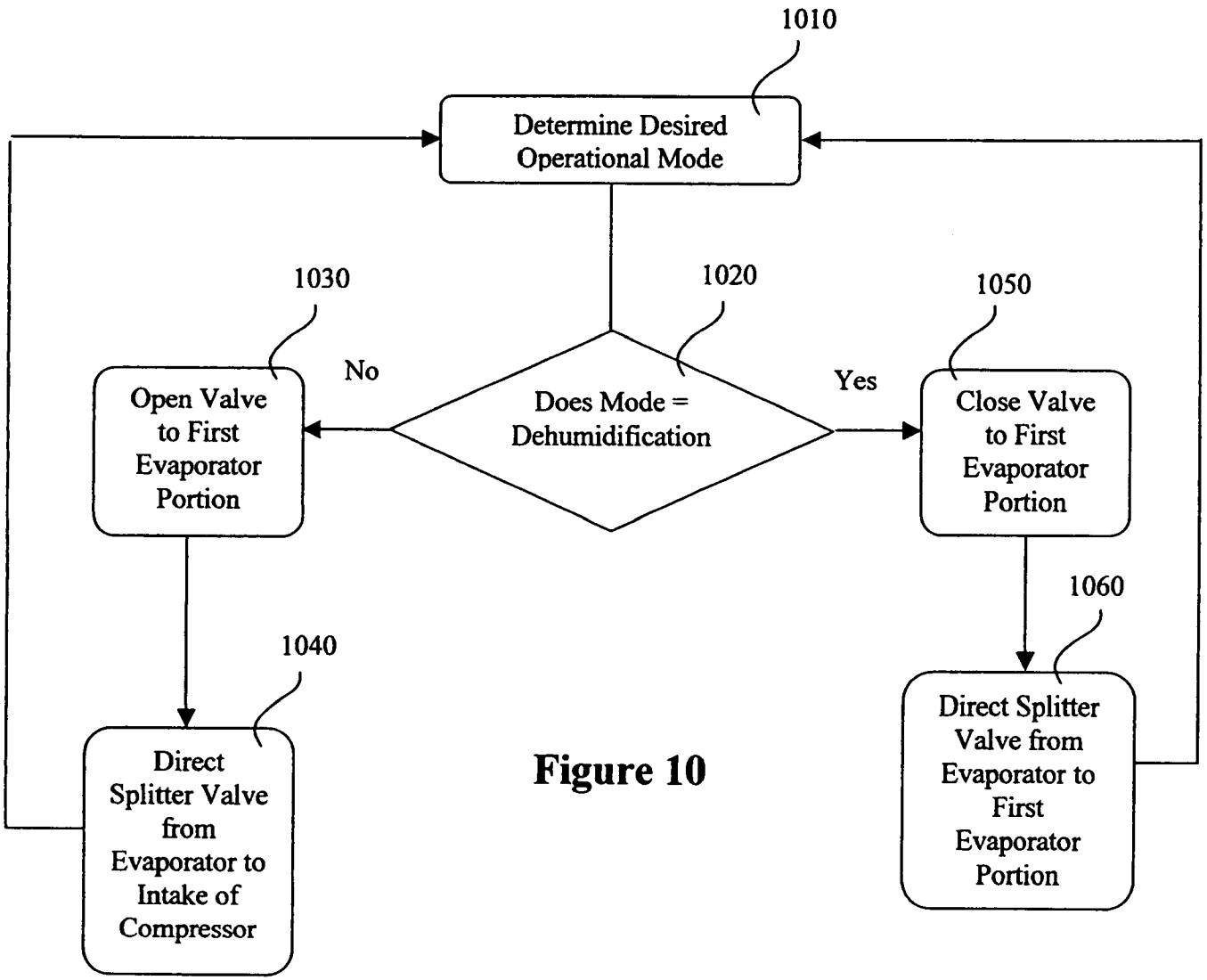
FIG. 10 illustrates a control method of another embodiment of the present invention.

FIG. 10 shows another control method according to the present invention. The method includes a mode determination step 1010 where the operational mode of the system is determined. As in the method shown in FIG. 9, the operational mode can be provided by the controller and/or user, where the mode can either be cooling only or require dehumidification mode. Examples of control systems for determination of the operational mode are described in further detail below in the discussion of FIGS. 12 and 13. The method then includes a decisional step 1020 wherein it is determined whether dehumidification mode is required or not. If the determination in step 1020 is "NO" (i.e., no dehumidification mode is required), then the method proceeds to step 1030 wherein the valve to the first evaporator portion 220 is opened or remains open. After or concurrently with step 1030, three-way valve 610 is set in a flow directing step 1040 to provide refrigerant flow from the discharge line 310 of the partitioned evaporator 200 to the intake of the compressor 130. The opening of the first evaporator portion 220 and the setting of the three-way valve 610 allow the flow of refrigerant to both the first and second evaporator portions 220 and 230 to provide cooling to the heat transfer fluid 510. If the decisional step 1020 is "YES" (i.e., dehumidification mode is required), then the valve to the first evaporator portion 220 is closed or remains closed. After or concurrently with step 1050, three-way valve 610 is set in a flow directing step 1060 to provide refrigerant flow from the discharge of the compressor to the cooling mode suction line 310 of the partitioned evaporator 200. The hot gas refrigerant from the discharge of the compressor 130 flows into the first evaporator portion 220 and provides heat to the first evaporator portion 220. The directing of hot gas refrigerant to the first evaporator portion 220 allows the first evaporator portion 220 to exchange heat with the heat transfer fluid 510 entering the partitioned evaporator 200. The inlet flow 510 of heat transfer fluid is cooled and dehumidified by the second evaporator portion 230 and is heated by heat exchange with the hot gas from the discharge of the compressor 130 in the isolated first evaporator portion 220. The outlet flow 515 is a mixture of the cooled, dehumidified air that flowed through the second evaporator portion 230 and the heated air that flowed though the first evaporator portion 220. The resultant outlet flow 515 is dehumidified air that is not overcooled. After either the three-way valve 610 directing steps 1040 or 1060, the method returns to the determination step 1010 and the method repeats.

Although FIG. 10 shows that the decisional step provides a "YES" or "NO" in step 1020, the method is not limited to an open or closed isolation valve 250. A flow restriction valve may also be used. The use of a flow restriction valve allows the amount of flow into the first evaporator portion 220 to be varied. For example, the flow restriction valve may be used in an operational mode that is open to full flow, partially restricted flow or closed to flow, depending on the signal from a controller. Alternatively, the flow into the first evaporator portion 220 from the discharge of the compressor 130 in dehumidification mode may be varied through use of the three-way valve 610, depending on the signal from a controller. The three-way valve 610 may also include flow restriction abilities that allow the flow of refrigerant to be varied. A controller, using inputs, such as refrigerant temperature, heat transfer fluid temperatures, and humidity readings, provides a signal to the restriction valve or the three-way valve 610 to determine the amount of refrigerant flow permitted through the isolation valve 250 or the amount of hot gas refrigerant permitted through the first evaporator portion 220.

Figure 11:
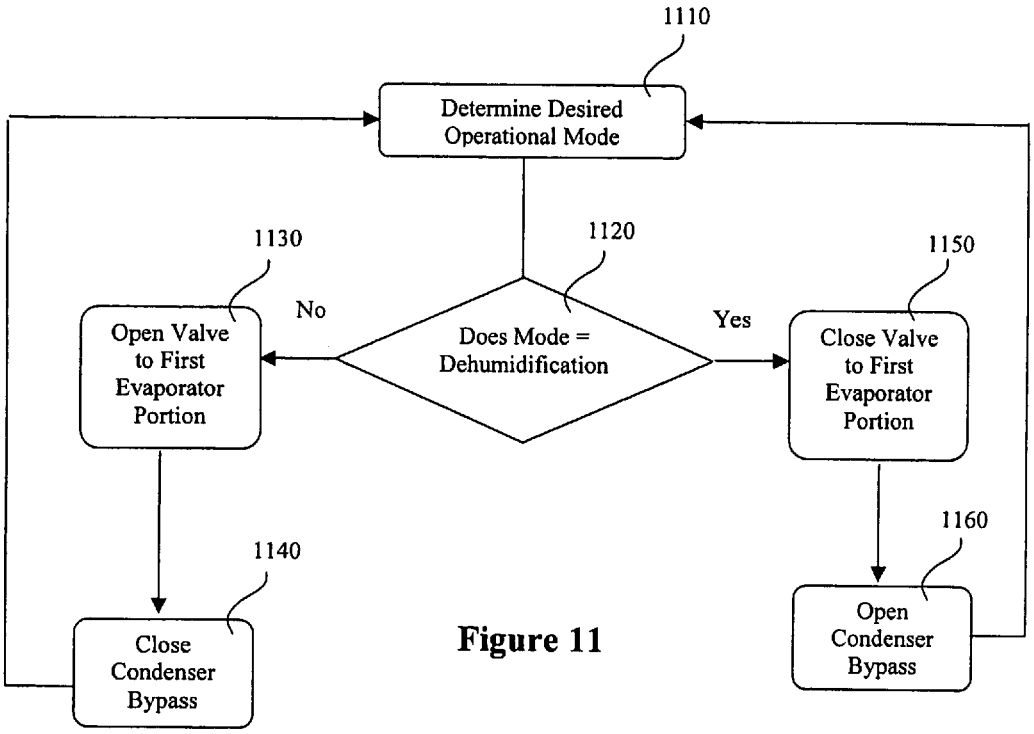
FIG. 11 illustrates a control method of a further embodiment of the present invention.

FIG. 11 shows another control method according to the present invention. The method includes a mode determination step 1110 where the operational mode of the system is determined. As in the method shown in FIG. 9, the operational mode can be provided by the controller and/or user, where the mode can either be cooling only or require dehumidification mode. The method then includes a decisional step 1120 wherein it is determined whether dehumidification mode is required or not. If the determination in step 1120 is "NO" (i.e., no dehumidification mode required), then the method proceeds to step 1130 wherein the valve to the first evaporator portion 220 is opened or remains open. After or concurrently with step 1130, a bypass 410 is closed from refrigerant flow in a bypass closing step 1140. The opening of the first evaporator portion 220 and the closing of the bypass 410 allow the flow of refrigerant to both the first and second evaporator portions 220 and 230 to provide cooling to the heat transfer fluid 510. If the decisional step 1120 is a "YES" (i.e., dehumidification mode is required), then the valve to the first evaporator portion 220 is closed or remains closed. After or concurrently with step 1150, the bypass 410 is opened to flow of refrigerant in a bypass opening step 1160. Hot gas refrigerant from the discharge of the compressor 130 flows through the bypass 410 and into the first evaporator portion 220 and provides heat to the first evaporator portion 220. The closing of the first evaporator portion 220 to the flow of refrigerant and the directing of hot gas refrigerant to the first evaporator portion 220 allows the first evaporator portion 220 to exchange heat with the heat transfer fluid 510 entering the partitioned evaporator 200. The inlet flow 510 of heat transfer fluid is cooled and dehumidified by the second evaporator portion 230 and is heated by heat exchange with the hot gas from the discharge of the compressor in the isolated first evaporator portion 220. The outlet flow 515 is a mixture of the cooled, dehumidified air that flowed through the second evaporator portion 230 and the heated air that flowed though the first evaporator portion 220. The resultant outlet flow 515 is dehumidified air that is not overcooled. After either the bypass closing step 1140 or the bypass opening step 1160, the method returns to the determination step 1110 and the method repeats.

Although FIG. 11 shows that the decisional step 1120 provides a "YES" or "NO" in decisional step 1120, the method is not limited to an open or closed isolation valve 250. A flow restriction valve may also be used. The use of a flow restriction valve allows the amount of flow into the first evaporator portion 220 to be varied. For example, the flow restriction valve may be used in an operational mode that is open to full flow, partially restricted flow or closed to flow, depending on the signal from a controller. Additionally, the flow through the bypass line 410 may be varied through use of the bypass shutoff valve 440 and/or flow restriction valve 430, depending on the signal from a controller. A controller, using inputs, such as refrigerant temperature, heat transfer fluid temperatures, and humidity readings, provides a signal to isolation valve 250, bypass shutoff valve 440 and flow restriction valve 430 to determine the amount of refrigerant flow permitted through the restricting valve in place of isolation valve 250 and the amount of hot gas refrigerant permitted through the first evaporator portion 220.

Figure 12:
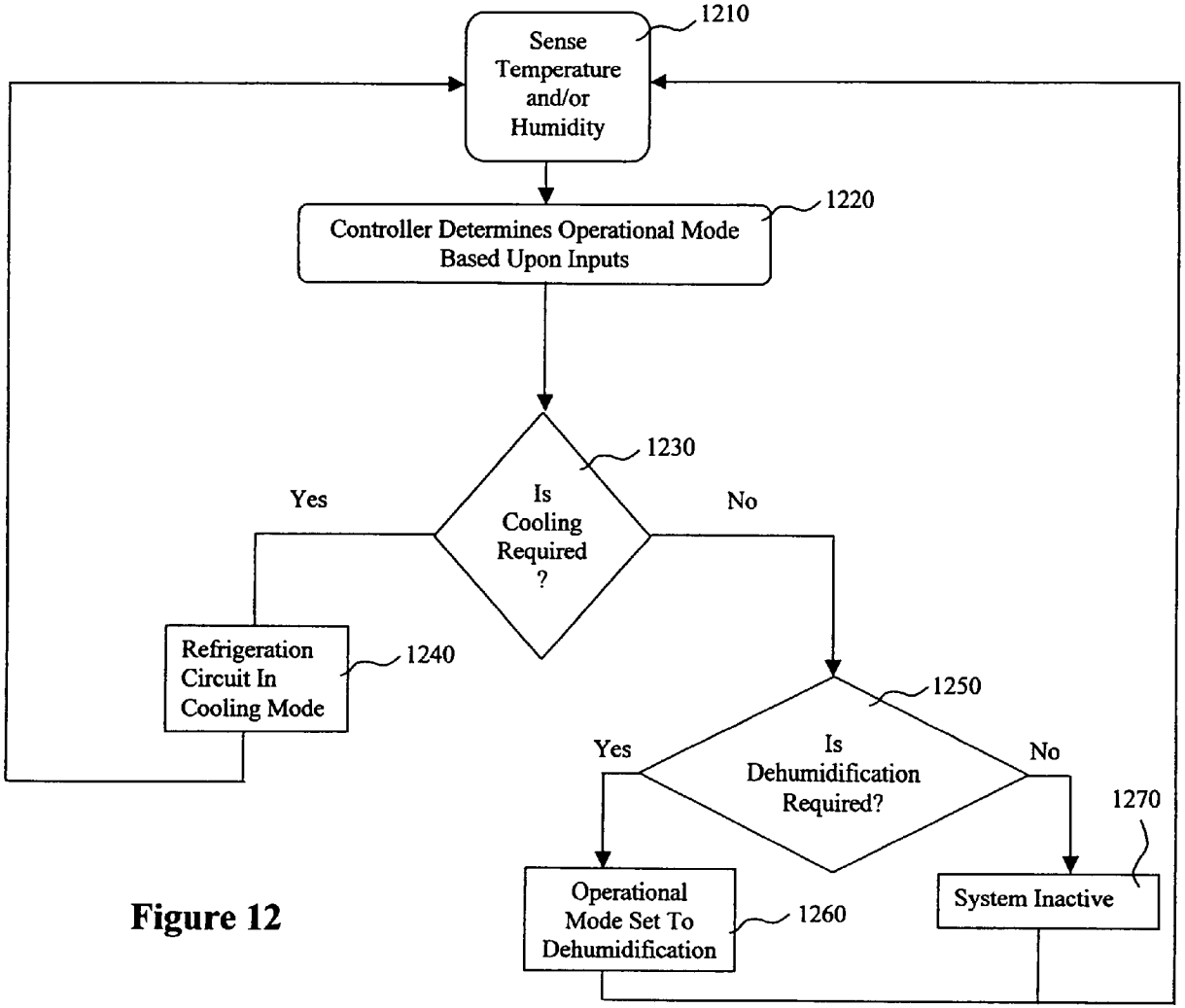
FIG. 12 illustrates a control method of a further embodiment of the present invention.

FIG. 12 illustrates a control method according to the present invention that determines the operation mode of the partitioned evaporator 200. The determination of the operational mode is made through the use of a controller. This determination may be used in steps 910, 1010 and 1110 of FIGS. 9, 10 and 11, respectively. The determination takes place by first sensing temperature and/or humidity in step 1210. The sufficient temperature and/or humidity measurements are made for a controller to determine whether the heat transfer fluid requires cooling or dehumidification. The inputs from temperature sensors and humidity sensors are provided to the controller in step 1220, where the controller uses the sensed temperatures and/or humidity to determine the operational mode. In step 1220, the controller determines whether cooling is required and whether dehumidification is required. In a first decisional step 1230, it is determined whether the controller has determined that cooling is required. If the first decisional step 1230 determines "YES", cooling is required, the partitioned evaporator 200 in the refrigeration system 100 is set to allow flow into all of the circuits 210 in the partitioned evaporator 200 and cool across both the first and second evaporator portions 220 and 230 in step 1240. In addition to cooling, cooling mode also performs dehumidification. However, in a cooling mode, the temperature is only cooled and is not heated to increase the temperature of the second heat transfer fluid 155 once the second heat transfer fluid 155 travels through the evaporator. If the first decisional step 1230 determines "NO", then a second decisional step 1250 is made. The second decisional step 1250 determines whether the controller has determined that dehumidification (i.e., dehumidification without overcooling) is required. If the second decisional step 1250 determines "YES", dehumidification is required, the operational mode is set to dehumidification in step 1260, which corresponds to step 910, 1010 or 1110 in FIGS. 9-11, and the process continues with determination step 920, 1020 and 1120, as shown in FIGS. 9-11. If the second decisional step 1250 determines "NO", dehumidification is not required, the operational mode is set to inactive and the system runs neither a cooling nor a dehumidification cycle in step 1270.

Figure 13:
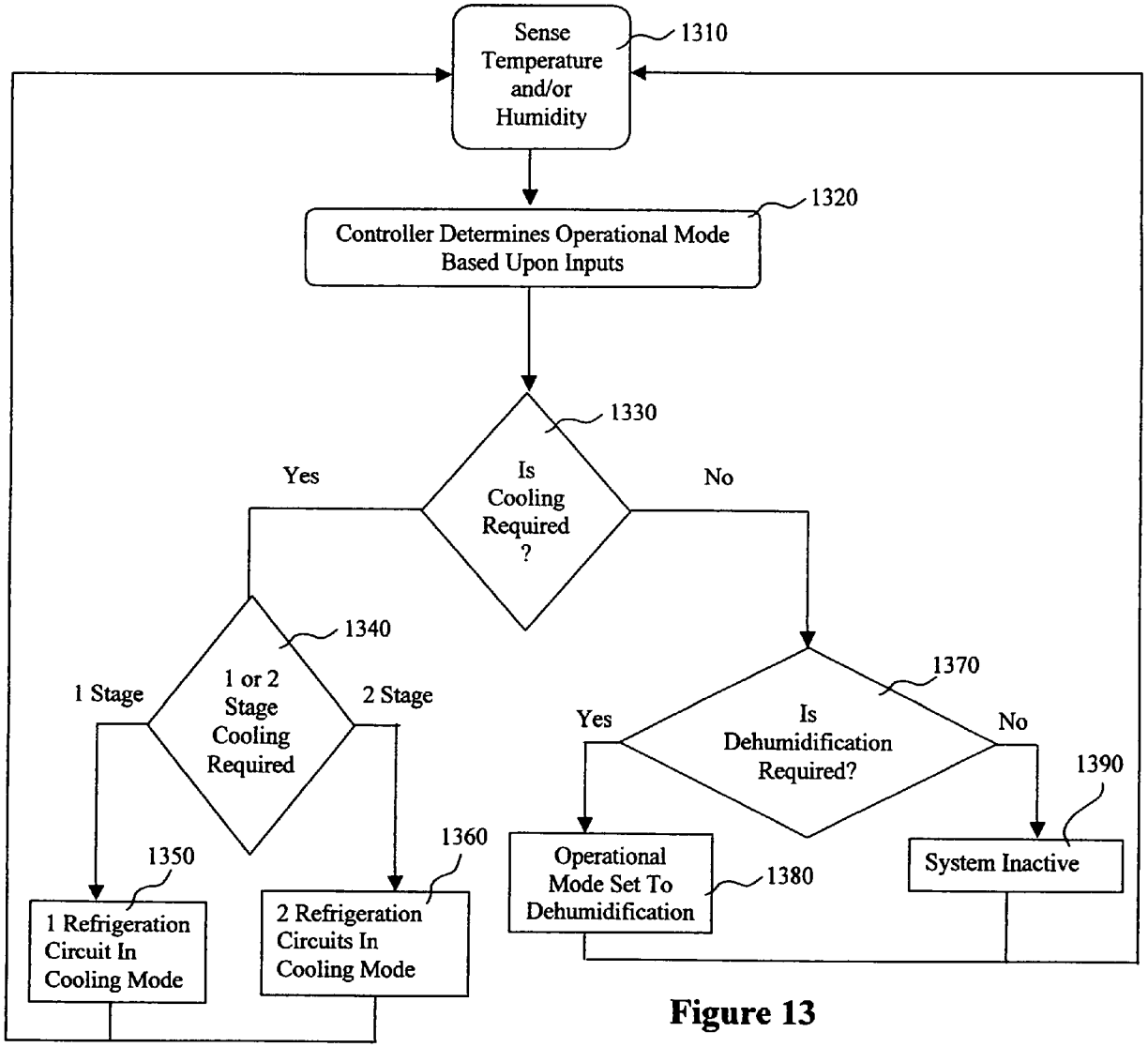
FIG. 13 illustrates a control method of a further embodiment of the present invention.

FIG. 13 shows an alternate control method according to the present invention that determines the operation mode of a multiple refrigerant system. In the system controlled in FIG. 13, multiple refrigerant systems 100 are utilized and one or more of the refrigerant systems 100 include a partitioned evaporator 200 according to the invention. The control method shown in FIG. 13 operates in a similar manner to FIG. 12 in that the controller receives inputs from temperature and/or humidity sensors in step 1310 and determines the operational mode of the system in step 1320. Likewise, if the first decisional step 1330 determines "NO", then a second decisional step 1370 is performed. The second decisional step 1370 determines whether the controller has determined that dehumidification mode (i.e., dehumidification without overcooling) is required. If the second decisional step 1370 determines "YES", dehumidification mode is required, the operational mode is set to dehumidification mode in step 1380. If multiple refrigerant systems 100 are present, the controller independently determines which of the refrigerant systems 100 are active or inactive, based upon the temperature of the air and amount of dehumidification required. When multiple refrigeration systems 100 are present, at least one refrigerant system 100 includes a partitioned evaporator 200. The controller independently determines which partitioned evaporator 200 is subject to isolation of the first evaporator portion 220, based upon the temperature of the air and amount of dehumidification required. However, if the second decisional step 1370 determines "NO", dehumidification mode is not required, the operational mode is set to inactive and the system runs neither a cooling nor a dehumidification cycle in step 1390. If the first decisional step 1330 determines "YES", cooling is required, a third decisional step 1340 is performed. In the third decisional step 1340, a determination as to the number of stages are to be activated in order to provide the cooling. Each stage has an evaporator capable of providing cooling to the second heat transfer fluid 155. The greater the number of stages activated, the greater the amount of cooling provided. At least one of the multiple refrigerant circuits includes a partitioned evaporator 200. If the controller determines that the cooling demand only requires one refrigerant system 100 to be active, one refrigerant system 100 will be used to cool second heat transfer fluid 155 in step 1350. When the partitioned evaporator 200 is used to operate in cooling mode, the partitioned evaporator 200 is configured to allow flow into all of the circuits 210 in the partition evaporator 200 and cool across both the first and second evaporator portions 220 and 230 in step 1350. If multiple partitioned evaporator 200 is present, all of the circuits 210 in each of the partitioned evaporator 200 allow flow of refrigerant into both the first and second evaporator portions 220 and 230 and cool the second heat transfer fluid 155.

The present invention is not limited to the control methods shown in FIGS. 9-13. The partitioned evaporator 200 may be used in one or more refrigerant circuits of multiple refrigerant circuit systems, where the control of the reheating capabilities within the first evaporator portion 220 of the partitioned evaporator 200 may be independently controlled to provide the desired temperature and/or humidity within the conditioned space. Any combination of cooling, reheating, or modulation of combinations of cooling and reheating may be used with the present invention.

Although the partitioned evaporator 200 has been illustrated as containing two evaporator portions 220 and 230, the partitioned evaporator 200 is not limited to two portions. Any number of portions may be used, so long as one or more of the portions include means to isolate the respective portion from refrigerant flow.

In another embodiment, refrigerant circuits 210 may also be isolated individually within the first and/or second distributor. The circuits may be isolated with flow blocking means or flow restriction means. In this embodiment, a controller is used to determine the number of circuits isolated. The number of circuits isolated relates to the amount of cooling and/or heating of dehumidified air required and may be adjusted by the controller.

The lack of additional piping also allows retrofitting of the system of the present invention into existing systems. Because the system utilizes the same components as existing systems, the system takes up approximately the same volume as existing HVAC systems. Therefore, the method and system of the present invention may be used in existing systems whose piping has arranged according to the present invention.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of operating an HVAC system, the method comprising:

providing an HVAC system configured to operate in at least two modes of operation, the at least two modes of operation comprising a cooling mode and a reheat mode, the HVAC system comprising a compressor, a condenser, and an evaporator connected in a closed refrigerant loop, the evaporator comprising a plurality of refrigerant circuits, the plurality of refrigerant circuits comprising a first portion and a second portion;

determining a mode of operation for the HVAC system;

if the determined mode of operation is the cooling mode:

flowing a refrigerant from the compressor to the condenser, from the condenser to the first portion, from the condenser to the second portion, from the first portion to the compressor, and from the second portion to the compressor; and flowing a heat transfer fluid through the evaporator, the flow of heat transfer fluid being in a heat exchange relationship with the refrigerant flowing respectively through the first portion and the second portion, wherein the first portion and the second portion receive the flow of heat transfer fluid substantially simultaneously;

if the determined mode of operation is the reheat mode:

substantially isolating the first portion from receiving the flow of the refrigerant from the condenser;

flowing the refrigerant from the compressor to the condenser, from the condenser to the second portion, from the second portion to the compressor;

substantially simultaneously flowing the refrigerant from the compressor to the first portion, from the first portion to the second portion, from the second portion to the compressor; and flowing a heat transfer fluid through the evaporator, the flow of the heat transfer fluid being in a heat exchange relationship with the refrigerant flowing through the first portion and with the refrigerant flowing through the second portion, wherein the first portion and the second portion receive the flow of the heat transfer fluid substantially simultaneously.

2. The method of claim 1, wherein the first portion comprises a first distributor and a first suction header, and wherein the second portion comprises a second distributor and a second suction header.

3. The method of claim 2, wherein substantially simultaneously flowing the refrigerant from the compressor into the first portion, from the first portion into the second portion, from the second portion to the compressor comprises:

flowing the refrigerant into the first portion through the first suction header;

flowing the refrigerant out of the first portion through the first distributor;

flowing the refrigerant into the second portion through the second distributor; and flowing the refrigerant out of the second portion through the second suction header.

4. The method of claim 1, wherein providing an HVAC system does not include providing an HVAC system comprising a dedicated reheat coil.

5. The method of claim 1, wherein the step of substantially simultaneously flowing the refrigerant from the compressor to the first portion, from the first portion to the second portion, from the second portion to the compressor, further comprises condensing the refrigerant from a gas to a liquid as the refrigerant flows through the first portion.

6. The method of claim 1, wherein the heat transfer fluid is air.

7. A method of operating an HVAC system, the method comprising:

providing an HVAC system configured to operate in at least two modes of operation, the at least two modes of operation comprising a cooling mode and a reheat mode, the HVAC system comprising a compressor, a condenser, and an evaporator connected in a closed refrigerant loop, the evaporator comprising a plurality of refrigerant circuits, the plurality of refrigerant circuits comprising a first portion and a second portion;

determining a mode of operation for the HVAC system;

if the determined mode of operation is the cooling mode:

flowing a refrigerant from the compressor to the condenser, from the condenser to the first portion, from the condenser to the second portion, from the first portion to the compressor, and from the second portion to the compressor; and flowing a heat transfer fluid through the evaporator, the flow of the heat transfer fluid being in a heat exchange relationship with the refrigerant flowing respectively through the first portion and the second portion, wherein the first portion and the second portion receive the flow of the heat transfer fluid substantially simultaneously;

if the determined mode of operation is the reheat mode:

substantially isolating the first portion from receiving the flow of the refrigerant from the condenser;

flowing the refrigerant from the compressor to the condenser, from the condenser to the second portion, from the second portion to the compressor;

substantially simultaneously flowing the refrigerant from the compressor into the first portion, and from the first portion to the compressor; and flowing the heat transfer fluid through the evaporator, the flow of the heat transfer fluid being in a heat exchange relationship with the refrigerant flowing respectively through the first portion and the second portion, wherein the first portion and the second portion receive the flow of the heat transfer fluid substantially simultaneously.

8. The method of claim 7, wherein the first portion comprises a first distributor and a first suction header.

9. The method of claim 8, wherein substantially simultaneously flowing the refrigerant from the compressor into the first portion, and from the first portion to the compressor comprises:

flowing the refrigerant into the first portion through the first distributor; and flowing the refrigerant out of the first portion through the first suction header.

10. The method of claim 7, wherein providing an HVAC system does not include providing an HVAC system comprising a dedicated reheat coil.

11. The method of claim 1, wherein the step of substantially simultaneously flowing the refrigerant from the compressor to the first portion, from the first portion to the second portion, from the second portion to the compressor, further comprises condensing the refrigerant from a gas to a liquid as the refrigerant flows through the first portion.

* * * * *

UNITED STATES PATENT AND TRADEMARK OFFICE

CERTIFICATE OF CORRECTION

PATENT NO. : 7,845,185 B2
APPLICATION NO. : 11/165106
DATED : December 7, 2010
INVENTOR(S) : Knight et al.

It is certified that error appears in the above-identified patent and that said Letters Patent is hereby corrected as shown below:

Column 2, lines 54-57, "The evaporator arrangement also includes a valve configured and disposed to prevent refrigerant flow from the condenser to the first set an operational mode for the refrigeration cycle." should read --The evaporator arrangement also includes a valve configured and disposed to prevent refrigerant flow from the condenser to the first set of circuits upon being in a closed position. The method further includes determining an operational mode for the refrigeration cycle.--

Signed and Sealed this
Fifteenth Day of March, 2011

David J. Kappos

David J. Kappos
*Director of the United States Patent and Trademark Office*